United States Patent [19]

Boussemart et al.

[11] Patent Number: 4,553,772

[45] Date of Patent: Nov. 19, 1985

[54] SAFETY SKI BINDING

[75] Inventors: Jean-Pierre Boussemart, Choisy; Rene Bressand, Saint-Jorioz; Roger Pascal, Annecy-le-Vieux, all of France

[73] Assignee: Salomon S.A., Annecy, France

[21] Appl. No.: 476,202

[22] Filed: Mar. 17, 1983

[30] Foreign Application Priority Data

Mar. 17, 1982 [FR] France ..... 82 04948

[51] Int. Cl.[4] ..... A63C 9/00

[52] U.S. Cl. ..... 280/628; 280/634

[58] Field of Search ..... 280/628, 629, 630, 632, 280/634

[56] References Cited

U.S. PATENT DOCUMENTS

| | | | |
|---|---|---|---|
| 3,563,561 | 2/1971 | Mottet | 280/628 |
| 4,358,132 | 11/1982 | Beyl | 280/628 |
| 4,402,525 | 9/1983 | Solomon | 280/628 |
| 4,457,533 | 7/1984 | Salomon | 280/628 |

FOREIGN PATENT DOCUMENTS

| | | | |
|---|---|---|---|
| 1578761 | 6/1971 | Fed. Rep. of Germany . | |
| 2405514 | 8/1975 | Fed. Rep. of Germany | 280/628 |
| 3104633 | 12/1981 | Fed. Rep. of Germany | 280/628 |
| 1594026 | 7/1970 | France . | |
| 2031883 | 11/1970 | France . | |
| 7019251 | 1/1972 | France . | |
| 2138694 | 1/1973 | France . | |
| 7601102 | 8/1977 | France . | |
| 2418656 | 9/1979 | France . | |
| 7807805 | 10/1979 | France . | |
| 7808342 | 10/1979 | France . | |
| 2424037 | 11/1979 | France . | |
| 2480130 | 10/1981 | France | 280/628 |
| 8008557 | 10/1981 | France . | |

*Primary Examiner*—Joseph F. Peters, Jr.
*Assistant Examiner*—Ross Weaver
*Attorney, Agent, or Firm*—Sandler & Greenblum

[57] ABSTRACT

A ski binding adapted to pivot both laterally and vertically. The binding includes a support attached to the ski and an assembly adapted to pivot therearound. The assembly includes a jaw, a pivoting element and an elastic system. The support has a substantially flat surface biased into contact with a substantially flat surface on the pivoting element. The pivoting element pivots around a single vertical axis intersecting the longitudinal axis of the binding. The elastic system in one embodiment contacts the rear of the support. In another embodiment the elastic system contacts the rear of a rocker pivoting around the pivoting element, and contacting the rear of the support. Both the rear of the rocker and the rear of the support comprise a downwardly and rearwardly extending release incline and a downwardly and forwardly extending opening incline. The elastic system is compressed when it pivots vertically along the release incline, so as to bias the assembly toward its centered boot retaining position. The elastic system is decompressed when it moves onto the opening incline, thereby holding the assembly in an open position after the boot is released, for the reattachment of the boot. The release incline on the support may be shaped in the form of a trapezoid in one embodiment. This shape causes a reduction in the lateral release retention moment (which resists the lateral pivoting of the assembly) when the assembly undergoes a lateral and vertical pivoting simultaneously, as compared to lateral pivoting alone. In a second embodiment, this effect can be achieved by the proper choice of the position of the axis around which the rocker pivots. When the ski experiences a lateral stress, the assembly pivots laterally and moves forward.

78 Claims, 35 Drawing Figures

SAFETY SKI BINDING

REFERENCE TO RELATED COPENDING APPLICATION

Application Ser. No. 328,144 filed Dec. 7, 1981 is presently copending and relates to a pivotable binding in name of applicant. In addition, an application, Ser. No. 476,124 filed on the same date as this application is also copending and relates to a pivotable binding in the name of applicant.

FIELD OF THE INVENTION

The present invention relates to a safety binding adapted to releasably hold a boot on a ski. More particularly, the invention relates to a heel type binding adapted to hold the back end of the boot and to permit the boot to pivot both vertically and laterally.

BACKGROUND OF THE INVENTION

Bindings having a jaw that is adapted to hold a boot and move between a boot retention position and a release position are well known. Generally, this movement of the jaw is a vertical pivoting movement around an axis transverse to the longitudinal axis of the ski and/or binding, and occurs against the action of an elastic system. The elastic system usually comprises a mobile member biased by a spring against a release incline on a support attached to the ski. The binding described in French Pat. No. 76.01102 is an example of such a binding. However, such a binding has serious disadvantages because it only releases the boot when there is an upward stress on the ski. Thus, lateral release of the boot is not possible.

In addition, there are numerous bindings which provide only for lateral pivoting and release of the boot and these can be dangerous to the leg in the event of vertical stresses. For example, the binding described in French Pat. Nos. 78.07805 and 78.08342 only release the boot in the event of lateral stresses; no vertical release is provided for.

To solve this problem, bindings have been proposed having jaws that can pivot both vertically and laterally. The prior art includes many diverse bindings that can pivot laterally and vertically. Two such examples are French Pat. Nos. 70.19251 and 80.08557. The binding described in French Pat. No 70.19251 has a jaw mounted on a universal joint and biased to a centered retention position by an elastic locking system. French Pat. No. 80.08557 shows a jaw which laterally pivots around a vertical axis located on the longitudinal plane of symmetry of the ski. These bindings, however, still have serious disadvantages. Specifically, in these bindings and the relationship between the value of the vertical release forces and moments and the value of the lateral release forces and moments are not correct to ensure safe skiing.

There is, therefore, a need for a binding that can pivot both laterally and vertically so that the relationship between the vertical release retention forces and lateral release retention forces is correct.

SUMMARY OF THE INVENTION

It is thus an object of the present invention to provide a binding wherein the relationship between the vertical and lateral release forces and moments are correct for a satisfactory release of the boot.

This and other objects of the invention are achieved by a multidirectional safety binding that is particularly simple and reliable. It comprises a support attached to the ski, having a substantially flat front surface, and an assembly. The assembly comprises a jaw, adapted to hold at lease a portion of a boot and to pivot both vertically and laterally, a pivoting element, having a substantially flat rear surface and pivotable with respect to the support, and an elastic means. The elastic means biases the jaw against lateral and vertical pivoting and biases the front surface of the support and the rear surface of the pivoting element into contact with each other. The elastic means biases the binding to a centered retention position to retain the boot. Furthermore, the lateral pivoting of the assembly and the pivoting element is performed about one vertical axis passing through the longitudinal axis of the support.

The assembly further includes a body attached to the jaw and extending rearwardly and upwardly therefrom. The elastic system is housed in this body.

The jaw may be journalled on the pivoting element so as to be adapted to be pivoted vertically around an axis transverse to the longitudinal axis of the binding.

In one embodiment the support element includes an incline adapted to cooperate with the elastic system for producing a release retention moment resisting the vertical and lateral pivoting of the binding away from its centered retention position. Another embodiment places this incline on a rocker journalled on the pivoting element. This incline causes the lateral release retention moment to be reduced when the binding pivots laterally and vertically, as compared to the valve of the lateral release retention moment when the binding pivots only laterally. In the embodiment wherein the incline is on the support this effect occurs when the incline has a particular shape—e.g., trapezoidal. In the other embodiment wherein the incline is on a rocker, this effect occurs because the axis around which the rocker pivots causes the length of the lever arm to be reduced, when there is simultaneous lateral and vertical pivoting.

The present invention has other advantages. First, this reduction in the lateral release retention moment is accomplished without any slippage or play occurring between the elements of the binding. Second, the contact between the piston and the incline when the assembly pivots laterally as always occurs along a line of contact therebetween. Third, the ratio between the lateral release retention moment and the vertical release retention moment can be easily varied for satisfactory release of the boot by changing the shape of the incline or the lever arm of these moments by changing the axis around which the rocker pivots.

In another embodiment, the support has a rear portion and the elastic means contacts the rear portion of the support. The support has a vertical axis passing through the longitudinal axis thereof. The pivoting element is adapted to pivot around this axis. The support and pivoting element comprise a lateral pivoting system having a vertical retention means for vertically retaining the pivoting element in relation to the support. The vertical retention means includes a vertical retention groove on the front face of the support having beveled ends, and a vertical retention projection on the rear surface of the pivoting element adapted to engage the vertical retention groove. The vertical retention groove has the shape of at least part of a cylinder. The rear portion of the support comprises a release incline extending rearwardly and downwardly from the front portion of the support. The support also includes an opening incline extending downwardly and forwardly from one end of the release incline. The elastic means is adapted to contact and move over the rear portion of the support. When the assembly undergoes a pure lateral stress, the assembly pivots laterally and also moves forward.

The elastic means is adapted to pivot vertically and laterally. The support further comprises a compressing means for compressing the elastic means when the elastic means pivots vertically away from a centered boot retaining position. The compression means comprises a release incline extending downwardly and rearwardly from the front portion of the support.

The assembly further includes a body attached to the jaw wherein the elastic system is housed in the body and the jaw is in an open position when the boot is released. The support further comprises a decompressing means for decompressing the elastic means after the elastic means has been compressed by the compressing means and the boot has been released from the jaw. The decompressing means holds the jaw in its open position after the boot is released. The decompressing means comprises an opening incline extending downwardly and forwardly from the release incline.

The rear portion of the support comprises a release incline in the shape of a trapezoid whose two lateral edges converge downward. The rear portion of the support and the elastic system interact to produce a lateral release retention moment at a given lateral position of the assembly, which opposes the lateral pivoting of the assembly. The support further includes a reduction means for reducing this lateral release retention moment when the assembly pivots laterally and vertically as compared to when the assembly pivots laterally. The reduction means comprises a release incline in the shape of a trapezoid whose two lateral edges converge downward. In addition, the assembly may further include a body housing the elastic means, which is integral with the jaw.

In another embodiment, the pivoting element further includes a rocker journalled on the pivoting element so that the elastic means is adapted to contact the rocker. The support has a rear portion and the rocker has a front portion and a rear portion. The pivoting element contacts the front portion of the support and the front portion of the rocker is adapted to contact the rear portion of the support. The support has a vertical axis passing through its longitudinal axis and around which the pivoting element is adapted to pivot. The support and the pivoting element comprise a lateral pivoting system having a vertical retention means for vertically retaining the pivoting element in relation to the support element. The vertical retaining means may comprise a pin extending laterally through the jaw and on which the pivoting element is journalled, and a housing in the support adapted to engage the pin.

The rocker has a rear portion adapted to contact the elastic means. The rear portion of the rocker comprises a release incline extending downwardly and rearwardly from the front portion of the rocker when viewed from the top of the rocker. The elastic means is adapted to pivot vertically and the rocker further comprises a compressive means for compressing the elastic means when the elastic means pivots vertically away from a centered boot retaining position. The compressive means may be a release incline extending rearwardly and downwardly from the front portion of the rocker. The rocker may further include a release nose on the end of the release incline. When the elastic means contacts this nose, the boot is released.

The pivoting element may further include a decompressive means for decompressing the elastic means. It is so positioned that the elastic means contacts the opening incline when pivoting vertically passed the release nose. The decompressive means is an opening incline extending downwardly and forwardly from the front portion of the pivoting element. When the assembly experiences purely lateral stress it pivots laterally and moves forward.

The assembly may further include a locking means for locking the assembly in a centered boot retaining position when the boot is attached to the jaw when the assembly is in an open position. In one embodiment, the locking means comprises a spring for biasing the rocker into contact with the support. In another embodiment, the locking means comprises a projection on the elastic system. The projection biases the rocker against the support when the elastic means contacts the opening incline. In another embodiment, the locking means comprises an axis pin attaching the rocker to the pivoting element and around which the rocker pivots. The pin is so positioned that the elastic means biases the rocker against the support when the assembly is in its open position.

The interaction of the rocker and the elastic means produces a lateral release retention moment at a given lateral position of the assembly which opposes the lateral pivoting of the assembly. This moment is reduced by the rocker which includes a reduction means for reducing the lateral release retention moment at a given lateral position when the assembly pivots laterally land vertically, as compared to when the assembly pivots laterally. The reduction means may include a release incline extending rearwardly and downwardly from the front portion of the rocker.

In addition, in one embodiment the incline is positioned above a horizontal plane passing through the axis around which the rocker pivots, and in another embodiment the incline is positioned below a horizontal plane passing through the axis around which the rocker pivots.

In another embodiment, the assembly includes a body housing the elastic means, such that the jaw is integral within the body. A further embodiment shows the body to be journalled on the jaw around an axis transverse to the longitudinal axis of the binding.

In still another embodiment, the body includes a top stop and a bottom stop, and the jaw includes a top stop and a bottom stop. The stops are so positioned that when the assembly is in its centered boot retaining position the bottom stops of the body and the jaw are spaced apart to permit the vertical pivoting of the body with respect to the jaw toward the open position of the binding. The top stops are so positioned that they contact each other when the assembly is in its centered boot retaining position. In addition, the rocker has a projection thereon for mating with a recess in the support in another embodiment.

In still another embodiment, the elastic means includes a piston and a spring. In addition, the assembly further includes a body housing the elastic means, and a lever means journalled on the body for retracting the piston. In still a further embodiment, the elastic means includes a mobile member and a spring and the assembly further includes a body which houses the elastic means.

In this embodiment, the mobile member is a lever journalled on the body.

In still another embodiment, the body is journalled on the pivoting element.

In still another embodiment, the body includes an incline, and the jaw comprises at least one projection. The projection of the jaw and the incline of the body are so positioned that the projections engage the incline to pivot the jaw upward when the body is rotated in one direction away from the centered boot retaining position.

The body includes at least one bottom stop and the jaw includes at least one stop. The bottom stop of the body and the stop of the jaw are so positioned as to contact each other after the projection contacts the incline as the assembly pivots away from the centered boot retaining position.

The body further includes at least one lower stop and the pivoting element includes at least one bottom stop. The lower stop of the body and the bottom stop of the pivoting element are so positioned so that they contact each other and prevent further upward pivoting of the assembly when, at some point after assembly has pivoted upward to an open position where the boot is released. The angle through which the body pivots before the bottom stop of the body contacts the stop of the jaw is greater than the angle through which the jaw pivots. In addition, after the bottom stop of the body contacts the stop of the jaw as the assembly pivots, the angle through which the jaw pivots is at least as great as the angle through which the body pivots.

In another embodiment of the present invention, the lateral pivoting system further includes a lateral pivoting and forward moving means for permitting the pivoting element to pivot laterally and to permit the pivoting element and assembly to move forward. The lateral pivoting and forward moving means and the vertical retaining means comprise a pin extending laterally through the element and a housing or recess in the support, which is adapted to engage the pin.

In another embodiment of the present invention the binding comprises an assembly which includes a jaw, an elastic means and a release retention moment reduction means. The jaw is adapted to hold at least a portion of the boot and to pivot both laterally and vertically. The lateral pivoting of the jaw is performed around only one axis. The elastic means produces a lateral or vertical release retention moment for causing the jaw to resist pivoting. The release retention moment reduction means reduces the lateral release retention moment when the jaw pivots laterally and vertically, as compared to the lateral release retention moment when the jaw pivots laterally. The binding further includes a support and the assembly further includes a pivoting element adapted to pivot laterally. The elastic means biases the support and the pivoting element into contact with each other.

The support has a front face having at least a portion that is substantially flat, which is adapted to engage a substantially flat portion of the pivoting element. The jaw is journalled on the pivoting element around an axis transverse to the longitudinal axis of the binding. In addition, the assembly further includes a body, housing the elastic means and extending rearwardly and upwardly from the jaw.

In another embodiment, the support has a rear portion and the elastic means contacts the rear portion of the support. In addition, the elastic means is adapted to pivot vertically and laterally. Also, the support comprises a compressing means for compressing the elastic means when the elastic means pivots vertically away from a centered boot retaining position. The compressing means comprises a release incline extending downwardly and rearwardly from the front portion of the support.

The assembly further includes a body attached to the jaw which houses the elastic system. The support further includes a decompressing means for decompressing the elastic means after the elastic means has been compressed by the compressing means and the boot has been released from the jaw. The decompressing means holds the jaw in position after the boot has been released. The decompressing means comprises an opening incline extending downwardly and forwardly from the one end of the release incline. The rear portion of the support comprises a release incline in the shape of a trapezoid whose two lateral edges converge downward. The release retention moment reduction means is the release incline.

In still further embodiment, the pivoting element includes a rocker journalled on the pivoting element. The elastic means is adapted to contact this rocker. In addition, the support has a rear portion and the rocker has a front and rear portion so that the front portion of the rocker is adapted to contact the rear portion of the support. The elastic means contacts the rear portion of the rocker so that the front portion of the rocker is biased to contact the rear portion of the support. The rear portion of the rocker comprises a release incline extending rearwardly and downwardly from the front portion of the rocker when viewed from the top of the rocker. In this embodiment, the assembly is adapted to pivot laterally, and when the assembly experiences a purely lateral stress, the assembly pivots laterally and also moves forward.

BRIEF DESCRIPTION OF THE DRAWINGS

The invention will now be described by way of non-limiting example, the various embodiments of the invention illustrated in the annexed drawings in which:

FIG. 29 is a partial cross-sectional side view of an alternative embodiment of the binding in a boot retention position.

FIG. 30 illustrates a partial cross-sectional side view the binding in the course of a voluntary vertical release of the boot.

FIG. 31 illustrates a partial cross-sectional side view of an alternative embodiment of the binding, in its release position, when no boot is present.

FIG 32 is an exploded perspective view of various constitutive elements of the binding of FIGS. 29–31.

DETAILED DESCRIPTION OF THE PREFERRED EMBODIMENTS

Figure 1:
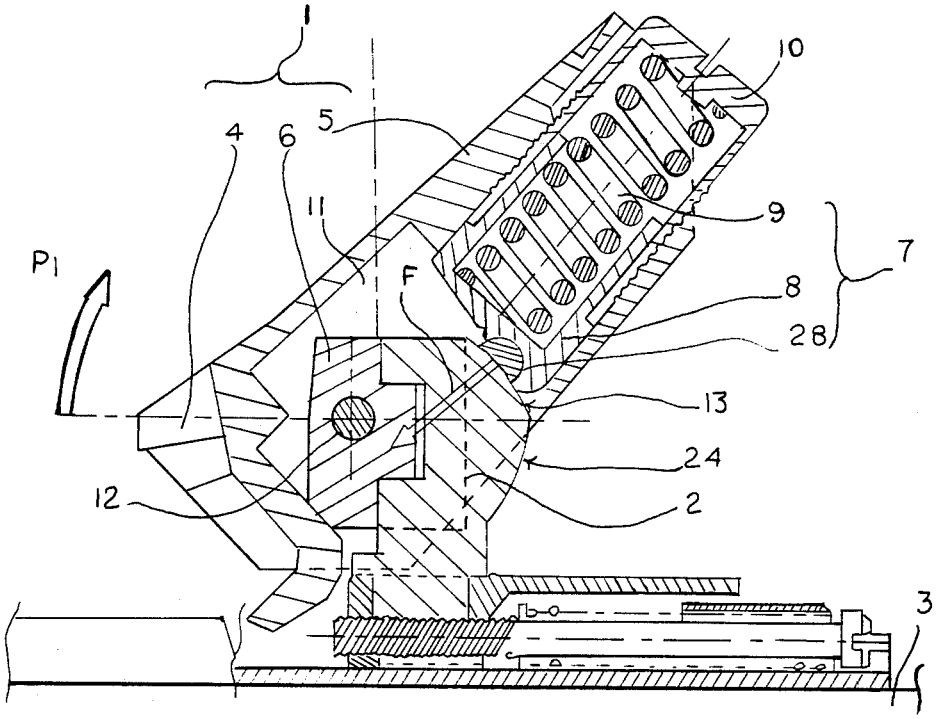
FIG. 1 is a longitudinal cross-sectional lateral view of the binding securing the boot.

In the various embodiments of the invention discussed below, identical elements have the same reference number while different elements which serve the same function are given the same reference number, but one or more apostrophe's have been added (e.g., 2', 2'', 2''' etc . . . ), after the reference number.

In addition, it should be noted that although the embodiments discussed hereinbelow refer to heel bindings, it is within the scope of the present invention to incorporate the present invention in toe bindings.

The embodiment according to the present invention illustrated in FIGS. 1–10 shows a binding having an assembly 1 which is adapted to move with respect to a support element or support 2 attached to ski 3. Assembly 1 comprises a jaw 4 attached to a body 5 and a pivoting element or pivot 6. In the binding shown in FIGS. 1–8, body 5 is one piece and is integral with jaw 4. However, other variations are envisioned and are illustrated in FIGS. 22–29 and 29–32, which will be discussed below.

Body 5 extends rearwardly and upwardly from jaw 4 and serves as a release lever to release the boot from the ski. Body 5 includes an elastic system 7 therein comprising a mobile member or piston 8 biased by a spring 9 which rests on an adjustment plug 10. Adjustment plug 10 adjusts the tension of spring 9 against piston 8. To the rear of jaw 4 is a housing 11 into which support element 2 extends and within which a pivoting element 6 is located. Pivoting element 6 is laterally fitted in housing 11 by an axis pin 12 so that jaw 4 is journalled on pivoting element 6 and pivots around a transverse and horizontal axis transverse to the longitudinal axis of the binding and ski and passing through axis pin 12.

Thus jaw 4 and assembly 1 are adapted to pivot vertically around said axis pin 12 in the direction $P_1$ shown in FIG. 1. Any vertical pivoting performed by jaw 4 is opposed by elastic system 7. Elastic system 7 exerts a force F called the vertical release retention force and a moment called the vertical release retention moment on a vertical release incline 13 located on the back or rear portion of support element 2 to retain jaw 4 and assembly 1 in the centered retaining or rest position shown in FIGS. 1 and 2.

Assembly 1 is also adapted to pivot laterally, around a vertical axis xx' passing through the longitudinal axis of the binding and/or support 2. This is accomplished by the lateral pivoting of pivoting element 6 as follows. Pivoting element 6 is adapted to contact or engage support 2. Contact between these two elements is guaranteed by elastic system 7 which biases these elements into contact with one another. Specifically, support has a front portion with a front surface 14 that is substantially flat, which is biased into contact with a substantially flat corresponding rear surface 16 of pivot 6. Thus, pivot 6 and support 2 form a lateral pivoting system wherein pivot 6 pivots laterally around axis xx' of support 2 against the bias of elastic system 7. This bias or force exerted by elastic system 7 to resist the lateral pivoting of assembly 1 and pivot 6 is called the lateral release retention force. The torque or moment created by the interaction of elastic system 7 and support 2 to resist lateral pivoting is called the lateral release retention moment.

To assist in the lateral pivoting of assembly 1 and lateral guiding of pivot 6 with respect to support 2, the lateral faces 17 land 18 of support 2 are at least partially cylindrical.

The lateral pivoting system also includes a set of elements to vertically retain pivot 6 in relation to support 2. These elements that retain pivot 6 comprise a groove and a projection. In the embodiment shown in FIG. 3, support 2 comprises a vertical retention groove 18 in which a vertical retention projection 19 of pivoting element 6 is adapted to engage or rest. The retention of pivot 6 in the vertical direction in support 2 is guaranteed by cooperation between edge 20 of projection 19 and the edge 21 of groove 18. Thus groove 18 is complementary to projection 19. In addition groove 18 is laterally beveled by the diverging sections or faces 22 and 23 so as to permit the lateral pivoting of projection 19 in relation to the support element.

Figure 2:
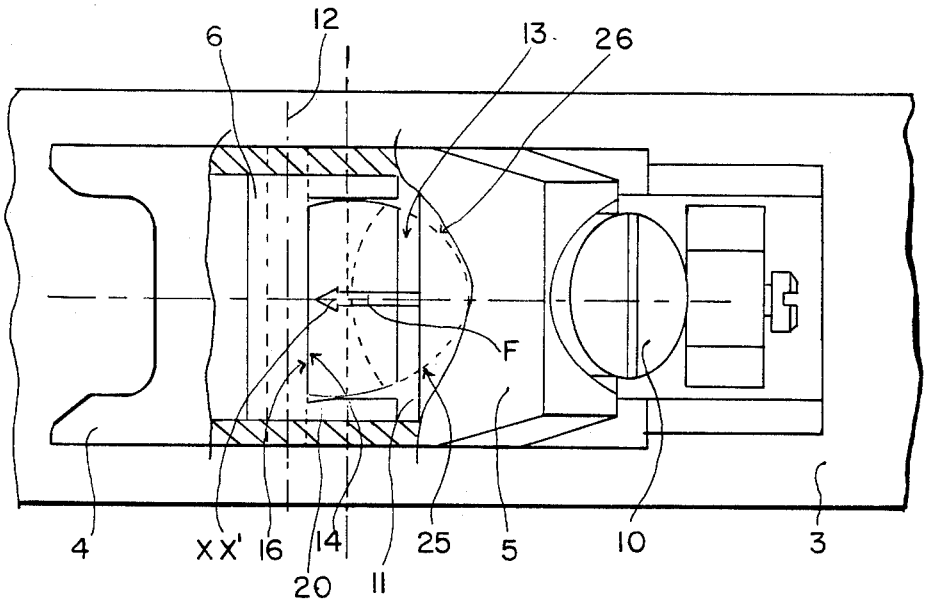
FIG. 2 is a partial cross-sectional top view of the binding securing the boot.
Figure 3:
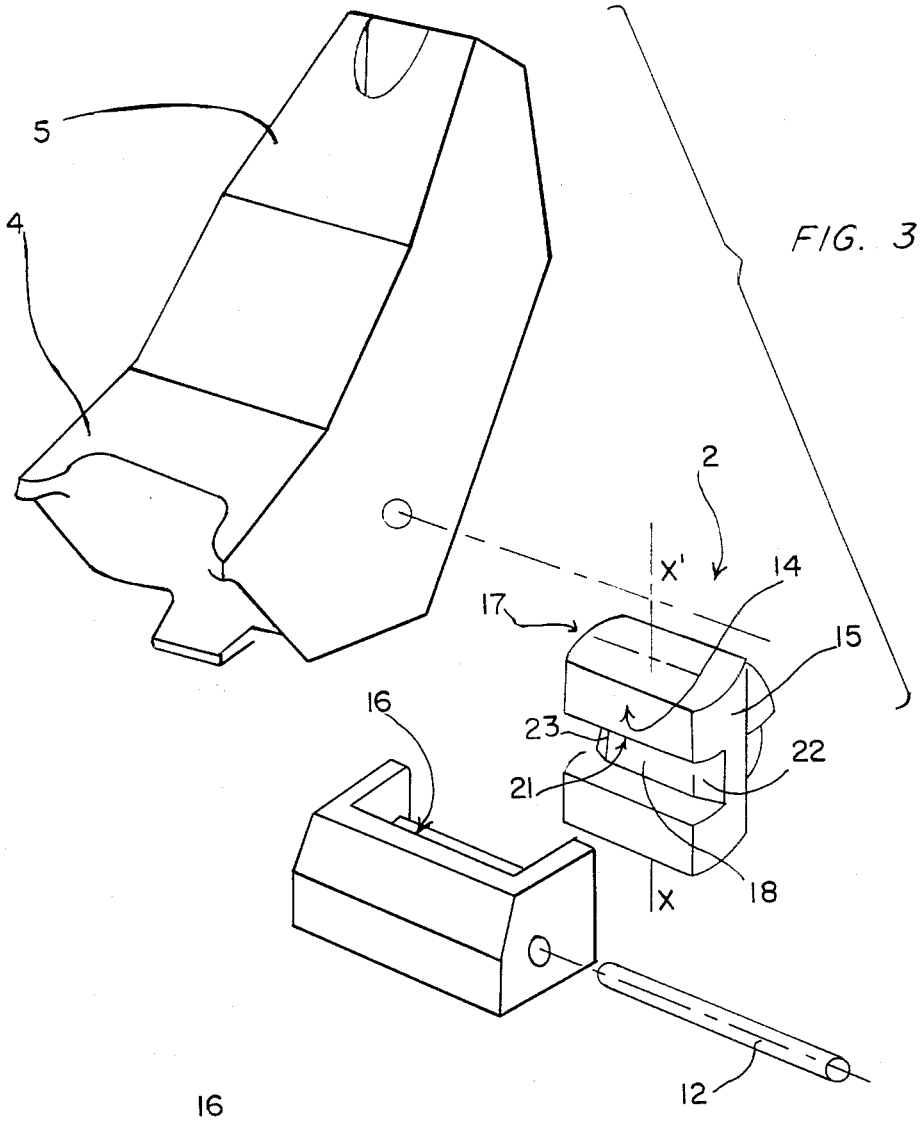
FIG. 3 is an exploded perspective view showing a variety of binding elements, including the jaw, the body, the pivoting element and the support element.
Figure 4:
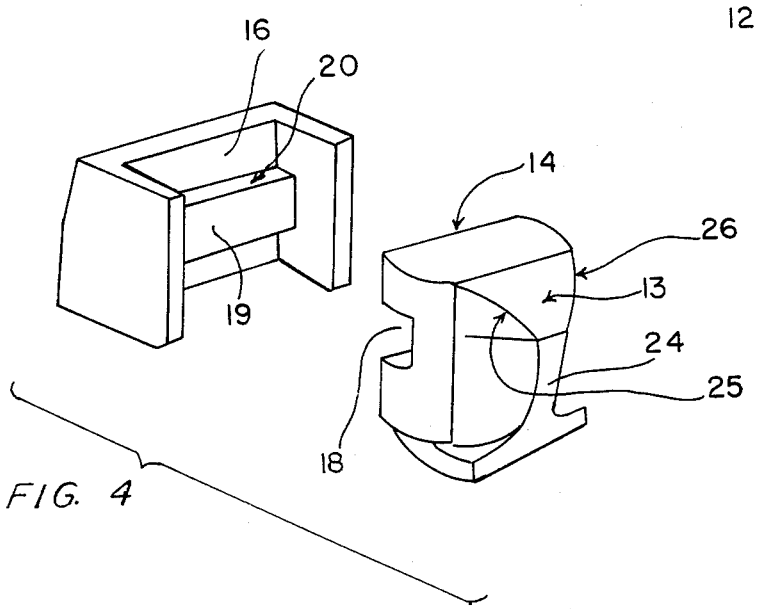
FIG. 4 is a perspective view illustrating the rear side of the pivoting element and of the support element.

In the embodiment shown in FIGS. 1–8, elastic system 7 biases support 2 and pivot 6 into contact with each other by using spring 9 to bias piston 8 against the back portion or surface of the support element 2. As seen in FIG. 3, the rear or back portion of support 2 comprises a vertical release incline 13 and an opening incline 24 extending downwardly and forwardly from the end thereof, which comprises nose 99. When pivot 6 pivots vertically in the direction $P_1$ in FIG. 1 around axis pin 12, piston 8 first travels downwardly along incline 13 so as to release the boot (thus the name vertical release incline for element 13). During this movement incline 13 compresses piston 8 against spring 7. Thus incline 13 functions as a compressing element. As piston 8 continues to move downwardly over the back of support 2, it passes nose 99, at which point the boot is released from jaw 4, and piston 8 then travels onto opening incline 24, which permits elastic system 7 to decompress, thereby guaranteeing that the jaw stays in the open position after release, a position in which the binding is ready to receive the boot therein again. Thus incline 24 functions as a decompressing element. The compressive effect of incline 13 and the decompressive effect of incline 24 occurs because incline 13 extends rearwardly and downwardly from the front portion of support 2 as one views support 2 from a point thereabove, and incline 24 extends downwardly and forwardly (or toward support 2 when viewed from above support 2) from end of the release incline.

Figure 7:
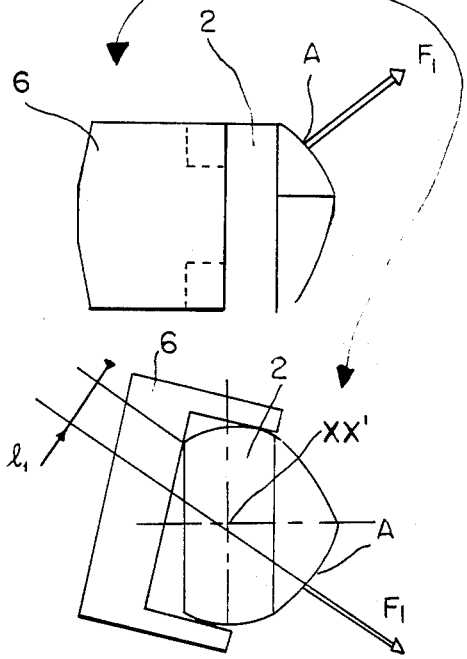
FIGS. 7 and 8 are schematic views of the pivoting element and support element, showing how the lateral release retention moment is reduced when lateral and vertical pivoting occur simultaneously.
Figure 8:
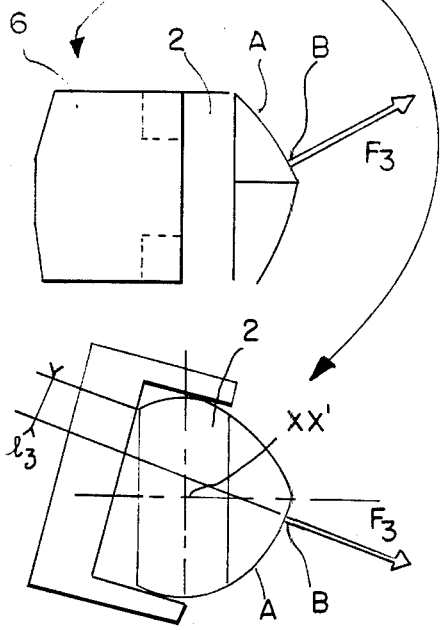

Release incline 13 comprises a curved surface in the shape of a trapezoid and has two lateral edges 25 and 26 converging downward. This shape causes a reduction in the lateral release retention moment when assembly 1 pivots laterally and vertically at the same time as will be explained below. This reduction in the lateral release retention force is necessary for satisfactory lateral release of the boot. It is illustrated in FIGS. 7 and 8.

Figure 5:
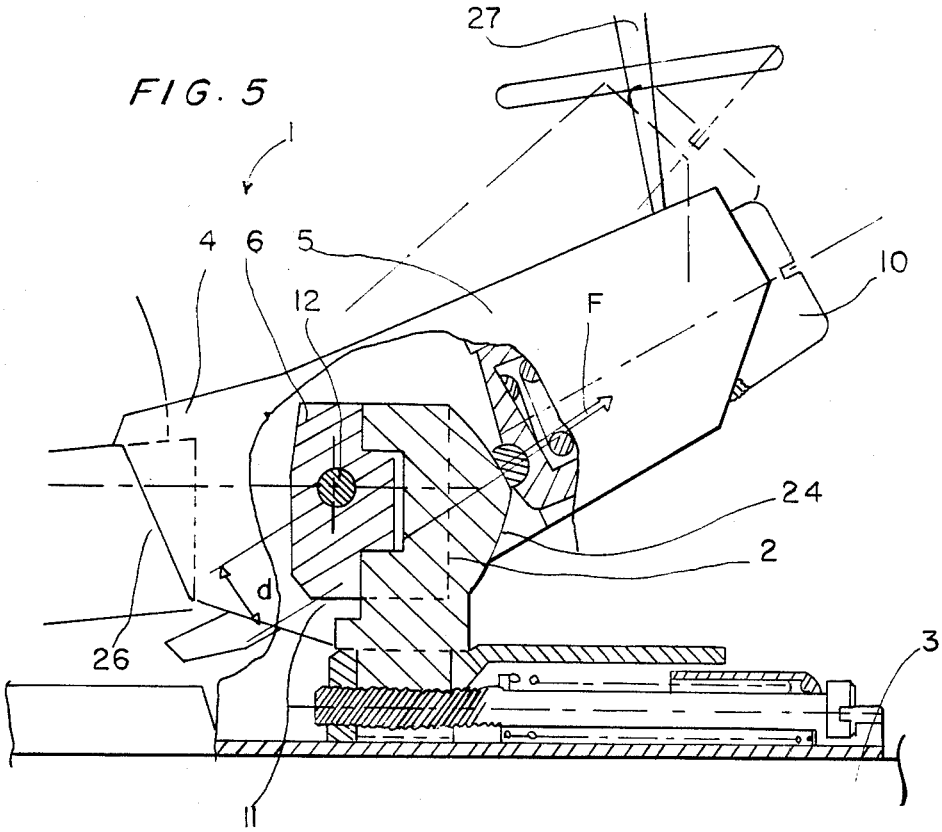
FIG. 5 is a partial longitudinal cross-sectional lateral view of the binding showing the binding in the course of either a vertical safety release or a voluntary vertical release.

FIGS. 1 and 2 show the binding in a centered boot retention position. The force of support element 2 on elastic system 7 and thus on movable assembly 1 is the force $F_1$. Force $F_1$ holds a part of jaw 4 in a vertical boot retention position and guarantees that pivoting element 6 will contact support element 2. FIG. 5 shows the binding in its open position where the boot is released from the binding due to a vertical pivoting of assembly 1, either because of a vertical safety release by the action of the heel of the boot against the binding during skiing, or during a voluntary release of the binding by means of, for example, rod 27 on the upper end of body 5. The release of the boot due to a vertical pivoting of assembly is a function of $F_1$ multiplied by d. d is the lever arm or perpendicular distance from a line in the direction of $F_1$, and axis pin 12.

Figure 6:
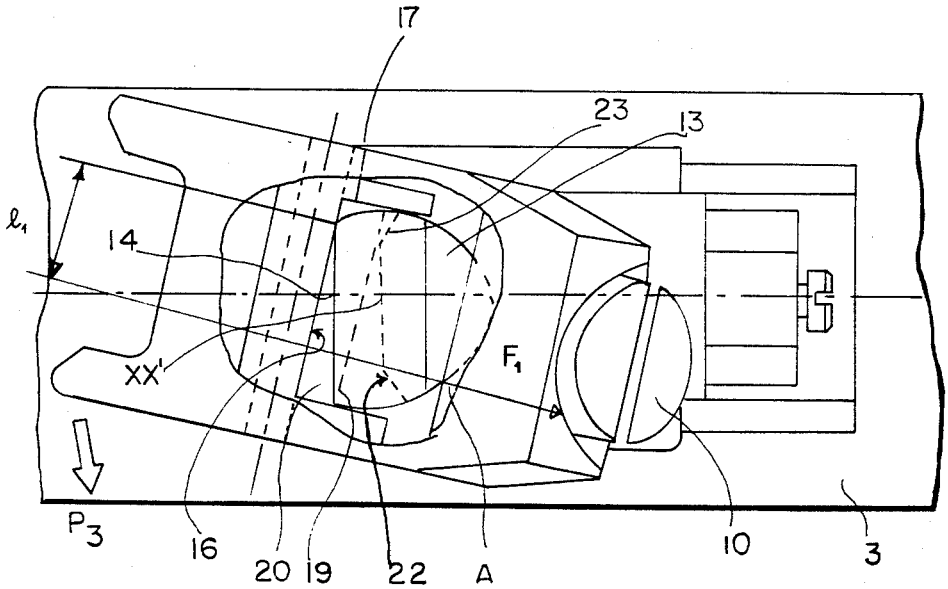
FIG. 6 is a partial cross-sectional top view, similar to FIG. 2, showing the binding in the course of a lateral release.

FIG. 6 shows one of the positions of assembly 1 during a lateral pivoting of assembly 1 in the direction $P_2$. As seen in FIG. 6 movable assembly 1 pivots around axis XX′ which is contrary to the bias of elastic system 7. Assembly 1 moves unexpectedly and in an unusual manner when it pivots in direction P2 around axis XX′. When assembly 1 and jaw 4 are stressed to undergo a pure rotation around XX′, for example, as when a lateral stress is applied to the boot, assembly 1 also travels in the forward direction. The lateral movement of the assembly and consequently the lateral release of the boot is a function of $F_1$ multiplied by $l_{1'}$, the lever arm, or the perpendicular distance between a line in the direction of $F_1$ and XX′.

It is, of course, possible for vertical forces acting on assembly 1 during skiing to be combined with lateral forces acting on the binding. Thus, the jaw would pivot in a way that would combine directions $P_1$ and $P_2$. In other words, assembly 1 would pivot vertically and laterally simultaneously. As has already been stated, release incline 13 has the general shape of a trapezoid so that when assembly 1 pivots laterally and vertically, the lateral release retention moment is decreased. FIGS. 7 and 8 show how, with such an arrangement, this effect occurs. FIG. 7 shows a lateral pivoting of assembly 1 which is not combined with a vertical pivoting. Piston 8 acts on incline 13 at point A on edge 25 and the value of the resistance offered by elastic system 7 to lateral pivoting (or the release retention moment) is a function of $F_1$ multiplied by $l_1$.

FIG. 8 shows a lateral pivoting of assembly 1 combined with a vertical pivoting. The piston's point of contact with vertical release incline 13 is moved from point A to point B. The point of contact is thus brought closer to a line passing through XX′ and parallel to $F_1$, thereby reducing the lever arm.

The value of the release retention moment which resists pivoting of assembly 1 away from its centered boot retaining position is a function of $F_3$ multiplied by $l_3$. The spring is compressed when assembly 1 pivots vertically, but due to the stiffness of the spring, $F_3$ has only a slightly greater value than $F_1$. On the other hand, $l_3$ is considerably less than $l_1$. As a result, $F_1$ multiplied by $l_1$ is greater than $F_3$ multiplied by $l_3$. thus, the value of the lateral release retention moment produced by elastic system 7 to resist lateral pivoting of assembly 1 is less when it is combined with a vertical pivoting of assembly than when lateral pivoting occurs alone.

To improve the elastic system's contact with support 2, a transverse pivoting pin 28 may be provided between piston 8 and incline 13, as seen in FIGS. 1 and 5.

Figure 9:
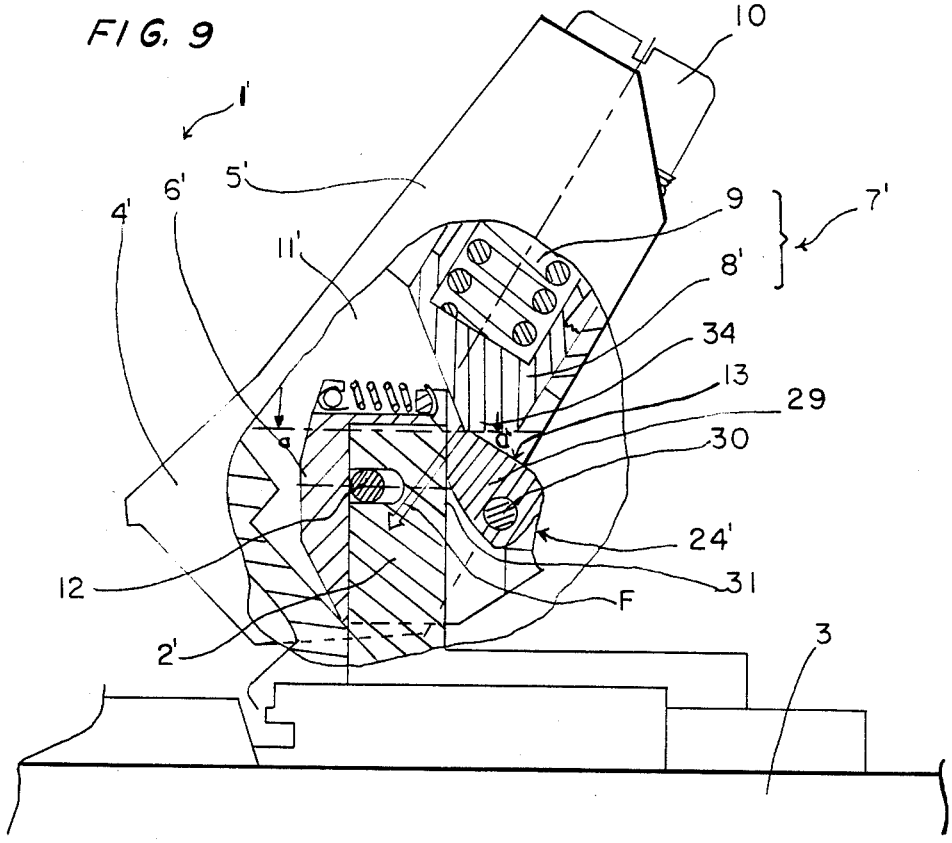
FIG. 9 illustrates a longitudinal cross-sectional lateral view of an alternative embodiment of the binding securing the boot.

FIGS. 9–21, 25 and 26 illustrate an embodiment of the invention wherein vertical release incline 13 is located on a rocker 29 journalled on pivoting element 6. Such a binding, a non-limiting example of which is shown in FIG. 9, comprises an assembly 1′ which is adapted to move in relation to a support element 2′ which is attached to the ski 3′. Movable assembly 1′ includes a jaw 4′ attached to a body 5′ and a pivoting element 6′. In the embodiment described in FIGS. 9–13, body 5′ is a single unit and is integral with jaw 4′. However, other embodiments may be used, wherein body 5′ is not integral with jaw 4, as seen in FIGS. 22, 23 and 29–32. Preferably, body 5′ extends rearwardly and upwardly from jaw 4′. Body 5′ comprises and houses an elastic system 7′ which includes a piston 8′ biased by a spring 9 which rests on the adjustment plug 10.

On the back of jaw 4′ and attached to body 5 is a housing 11′ into which support element 2′ extends and in which pivoting element 6′ is also positioned. Pivoting element 6′ is laterally placed in housing 11′ and held therein by axis pin 12. Jaw 4′ pivots in relation to pivoting element 6′ around a transverse and horizontal axis transverse to said binding and/or ski and passing through axis pin 12. Thus, jaw 4′ is adapted to pivot vertically in the direction of $P_1$, for example. This pivoting is done against the action of the elastic system 7′ which exerts a vertical release retention force F on vertical release incline 13.

Assembly 1 and pivoting element 6′ are also adapted to pivot laterally around a vertical axis XX′ passing through the longitudinal axis of the binding and/or support and/or ski. This is achieved as follows. Pivoting element 6′ is adapted to contact or engage support 2′. Contact between these two elements is guaranteed by elastic system 7′ which is adapted to biases these elements into contact with one another. Specifically, support 2′ has a front position with a front surface 14 that is substantially flat and which is biased into contact with a substantially flat corresponding rear surface 16 of pivot 6′ by elastic system 7′. Support 2′ and pivot 6′ comprise a lateral pivoting system, wherein pivot 6′ pivots laterally around axis XX′ of support 2′ against the bias of elastic system 7′. This bias exerted by elastic system 7′ to resist the lateral pivoting of assembly 1 and pivot 6′ is called the lateral release retention force.

To assist in the lateral pivoting of assembly 1′ and the lateral guiding of pivot 6′ with respect to support 2′, lateral faces 17 and 18 are provided and are at least partially cylindrical. The vertical retention of pivoting element 6′ is assured because axis pin 12 is engaged in a housing 18′ on support element 2′.

The rear of pivoting element 6′ has an opening therein for receiving axis pin 30. A rocker 29 is journalled on pivot 6′ by also passing axis pin 30 through an opening in rocker 29 so that rocker 29 may pivot vertically with respect to pivot 6 around an axis transverse to the binding and/or ski and passing through axis pin 30. The upper rear portion of rocker 29 has a vertical release incline 13 thereon. In addition, the back portion of support 2′ has an incline 31 thereon designed to assist in the lateral release of the boot as will be described below, and against which the front flat side or portion 32 of rocker 29 is biased. In the centered retention position shown in FIG. 9, piston 8′ is biased by spring 9 into contact with incline 13, thereby forcing the front flat side 32 of rocker 29 against the back flat portion or side of 31 of support element 2′. In this embodiment incline 13 is above a horizontal plane passing through the axis around which rocker 29 pivots.

When pivot 6′ pivots vertically in the direction $P_1$, nose 34 of piston 8′ travels downwardly along incline 13. Because incline 13 extends rearwardly and downwardly away from the front portion of rocker 29, incline 13 compresses elastic system 7′ and piston 8′. Thus incline 13 acts as a compressing element. Once nose 34 of piston 8′ passes release nose 33 of rocker 29, the boot is released from the boot and nose 34 of piston 8′ contacts the opening incline 24′ located at the back or rear portion of pivoting element 6′. Because opening incline 24 extends forwardly and downwardly toward the front of pivot 6′ incline 24 allows elastic system 7′ to expand. In other words, incline 24 is decompressive for elastic system 7. Because incline 24 is decompressive of elastic system 7′, the complete opening of jaw 4′ is guaranteed and jaw 4′ is held in its open position after release of the boot is effected. The binding is now ready to receive another boot.

Figure 10:
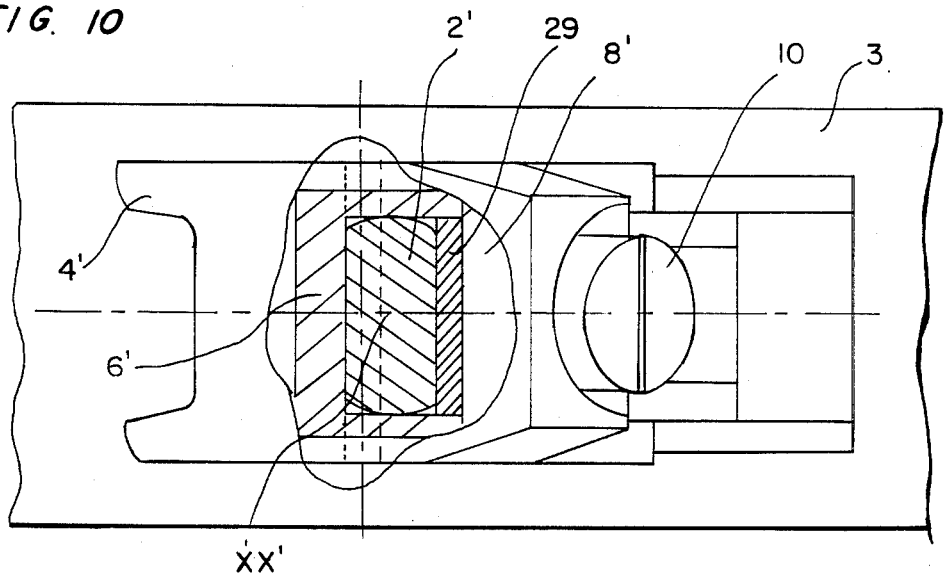
FIG. 10 is a partial cross-sectional top view along line aa' in FIG. 9.
Figure 11:
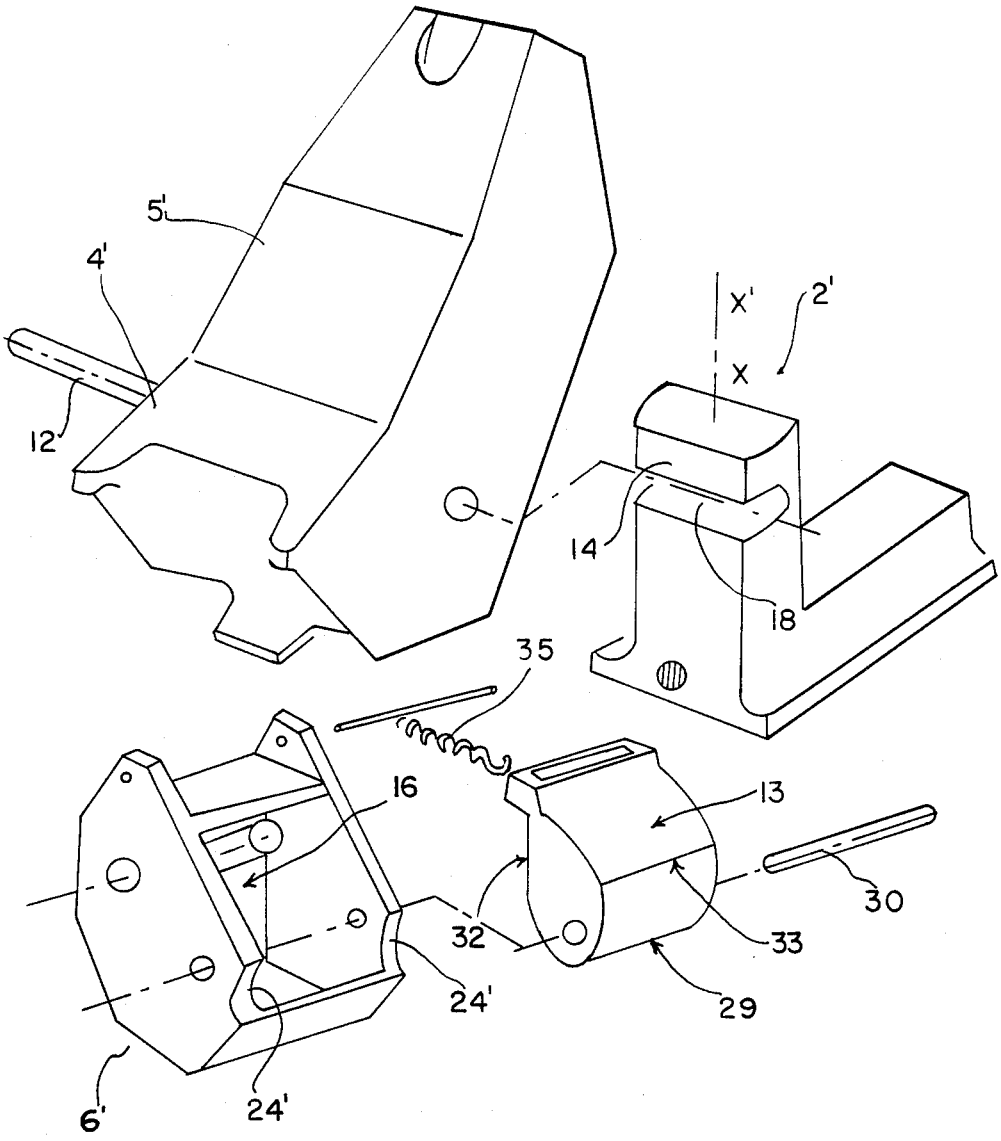
FIG. 11 is an exploded perspective view illustrating certain elements of the binding.

FIGS. 9 and 10 show the binding in its centered retention position. The action of incline 13 on the piston 8′ and thus on the movable assembly 1′ is a force F′ which holds jaw 4′ in its vertical retention position and also guarantees that pivoting element 6′ will be forced against support element 2′.

Figure 12:
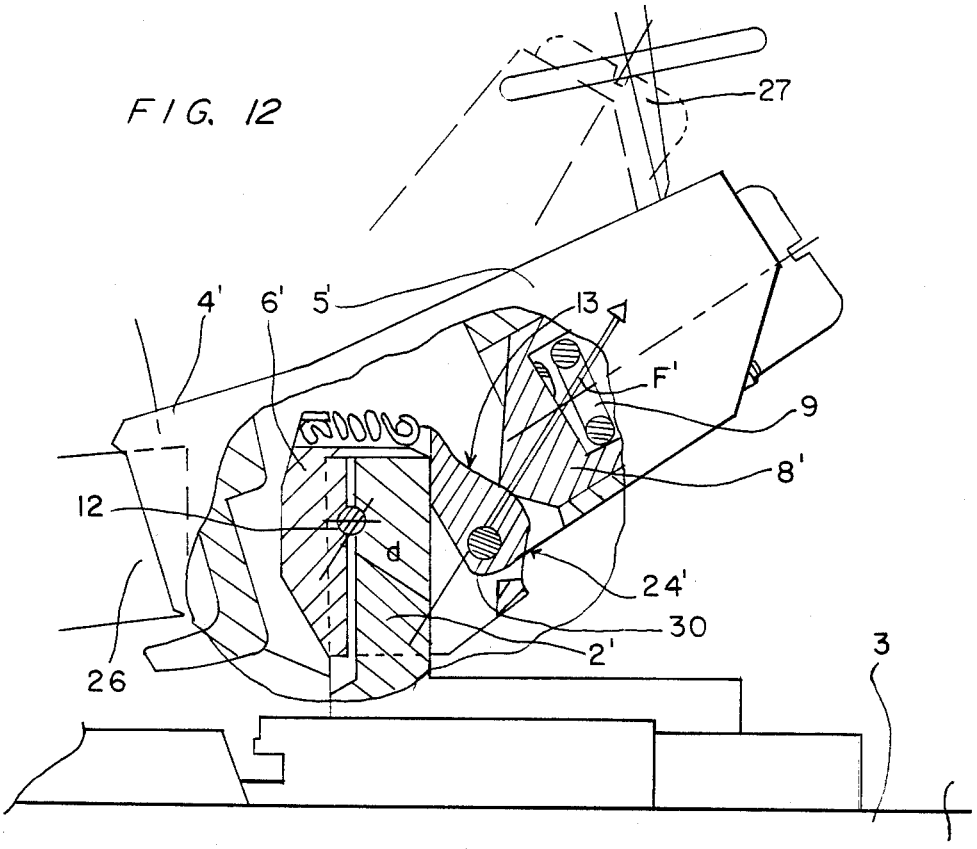
FIG. 12 is a longitudinal partial cross-sectional lateral view of the binding showing the binding in the course of either a vertical safety release or a voluntary vertical release, similar to FIG. 5.

FIG. 12 shows assembly 1′ and jaw 4′ moved out of its centered retaining position due to either a vertical safety release of the boot during skiing, caused by the heel 26 of the boot pivoting assembly 1 vertically or due to a voluntary release of the boot using, for example, a rod 27 on the upper end of body 5′, which serves as the lever to aid in the removal of the boot. Vertical pivoting of assembly 1′ and vertical release of the boot is a function of the vertical release retention moment, which is the vertical release retention force $F'_1$ multiplied by d, the lever arm, both of which are shown in FIG. 12.

Figure 13:
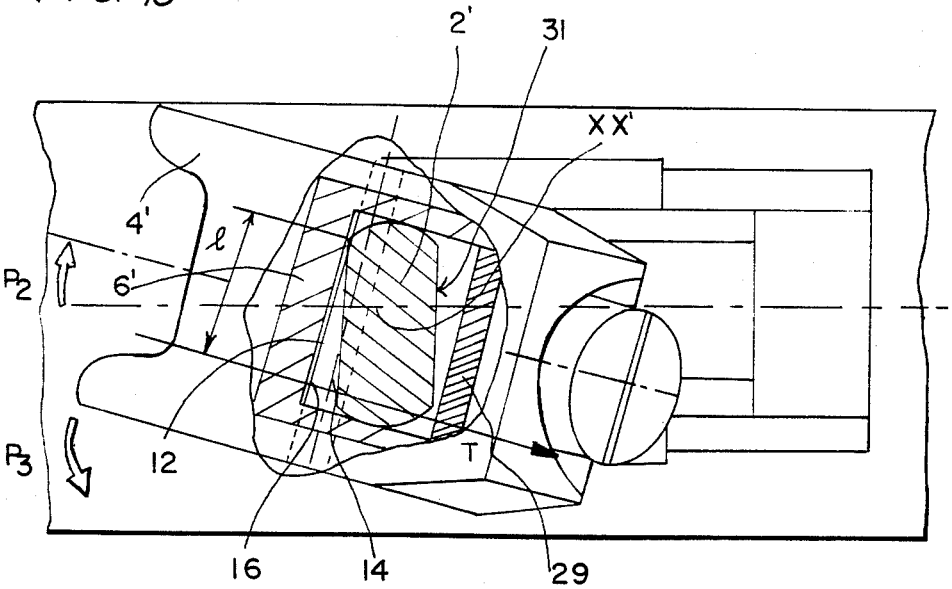
FIG. 13 is a partial cross-sectional top view, similar to FIG. 6, showing the binding in the course of lateral release.

FIG. 13 shows one of the positions of assembly 1′ during a lateral pivoting of assembly 1′ in the direction $P_2$. Movable assembly 1′ pivots around axis XX′ against the bias of elastic system 7′. Assembly 1′ moves unexpectedly and in an unusual manner when it pivots in direction $P_2$ around axis XX′. When assembly 1′ and jaw 4′ are stressed to undergo pure rotation around axis XX′, for example, when a lateral stress is applied to the boot, assembly 1′ also travels forward.

Lateral release of the boot and lateral pivoting assembly is a function of the lateral release retention moment which is a function of the lateral release retention force $T_1$ of the support on the rocker, multiplied by the lever arm l.

Figure 14:
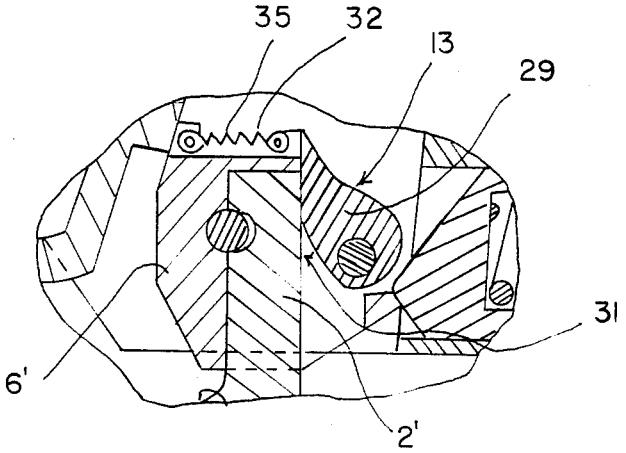
FIG. 14 illustrates a cross-sectional view of the locking system of the binding in the release position, when no boot is present.

FIG. 14 is a partial view of a longitudinal crosssection of assembly 1′ showing the binding in its open position in which a boot is not present but such that it can receive a boot. Piston 8′ is no longer in contact with rocker 29. To ensure that rocker 29 continues to contact support element 2, a spring 35 is provided. The presence of this spring is necessary to ensure the continued centered position of jaw 4′ necessary for replacing the boot attached to the binding, by forcing the front side 32 of the lever 29 into contact with the back side 31 of the support element 2′. Thus, spring 35 comprises a locking system for locking the binding in its centered position where the boot is placed therein. The structure of the binding may be altered, as in FIGS. 15–17, 20 and 21, which will be discussed below, to reduce the reliance on spring 35 for maintaining contact between rocker 29 and support 2. In these embodiments, the spring chosen to be spring 35 need only exert a small force, or spring 35 may be eliminated entirely.

Figure 15:
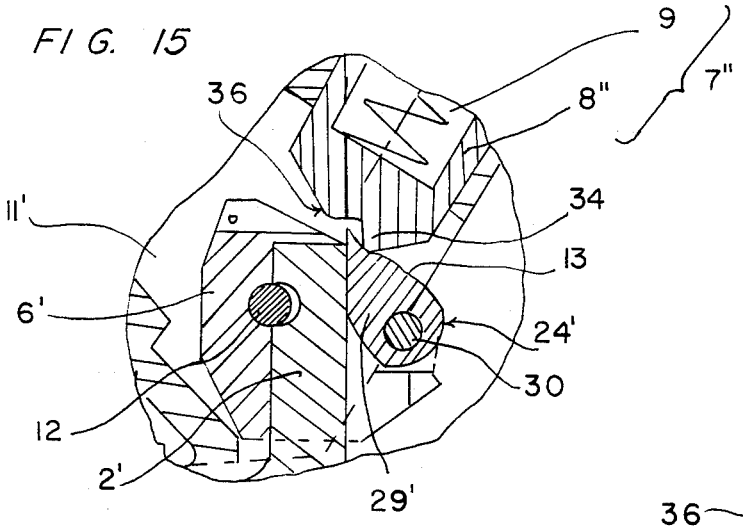
FIG. 15 illustrates a cross-sectional view of an alternative embodiment of the locking system in the lock position for skiing.
Figure 17:
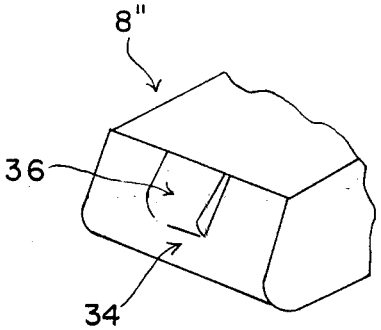
FIG. 17 is a perspective view of the corresponding piston used in FIGS. 15 and 16.
Figure 16:
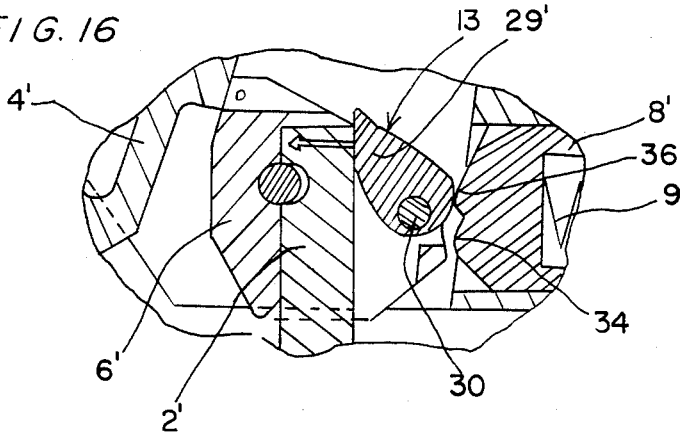
FIG. 16 illustrates a cross-sectional view of the alternative embodiment of the locking system with the binding in its release position.

As seen in FIGS. 15–17, piston 8″ includes a nose 34 which contacts and moves across rocker 29 during the vertical pivoting and release of the boot. Piston 8″ also includes a centered section having a projection 36 which comprises the locking system and is adapted to cooperate with rocker 29 so as to bias rocker 29 against support element 2 (FIG. 16) and ensure that the assembly and jaw will be retained in their centered position when a boot is attached to the binding without using spring 35.

It is evident that a vertical pivoting by the jaw in the direction $P_1$ can be combined with a lateral pivoting in the direction $P_2$ or $P_3$. When this occurs, due to the structure of the assembly and the position of the locking system the lateral release retention moment of the elastic system is reduced when compared to the release retention moment in the case of a pure lateral pivoting and/or release of the boot. This reduction is necessary for the satisfactory release of the boot and will be explained using schematic FIGS. 18 and 19.

Figure 18:
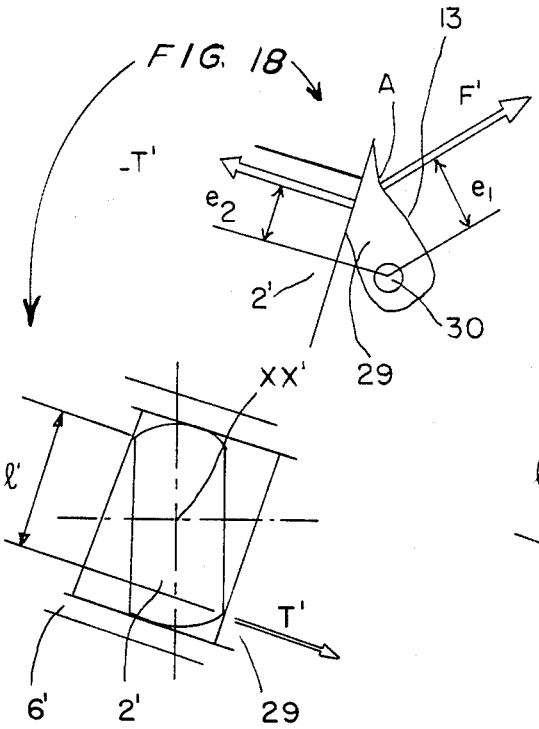
FIGS. 18 and 19 illustrate schematic views of the support and rocking element showing how the lateral release retention moment is reduced when lateral and vertical pivoting occur simultaneously in the embodiment shown in FIGS. 19–14.

FIG. 18 shows a lateral pivoting of the binding that is not combined with a vertical pivoting. The point of contact of the piston on the vertical release incline 13 is located at point A. The force T′ of the support element 2′ on rocker 29 guarantees that the centered position is biased against lateral pivoting; the effect of force T′ is such that, its absolute value is: $T' = F'e_1/e_2$, where $e_1$ is the distance from a line in the direction of $F_1$ to a line passing through pin 30 and parallel to the direction of $F_1$, and $e_2$ is the distance from a line in the direction of T' to a line passing through pin 30 and parallel to the direction of T'.

Figure 19:
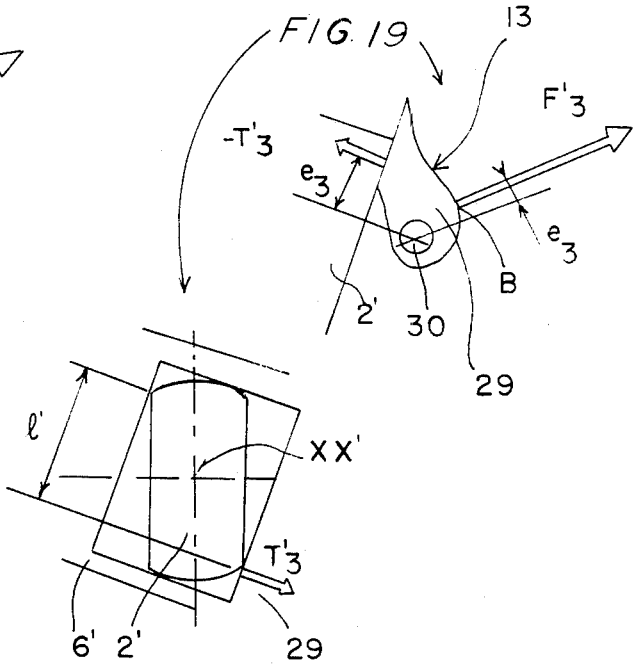

FIG. 19 shows a lateral pivoting of the jaw combined with a vertical pivoting of the jaw. The point of contact between the piston and the vertical release incline 13 has now moved from point A to point B. Force $F'_3$, the force of rocker 29 on the piston, which is substantially equal to F', has in relation to the axis 30 around which rocker 29 pivots, a lever arm $e_3$ which is much smaller than $e_1$. $e_3$ is the distance from a line in the direction of T'3 to a line parallel to T'3 and passing through pin 30. Under these conditions, $T'_3$, which defines the lateral retention release force, is equal, in absolute value, to $F'_3e_3/e_2$; thus $T'_3$ is much less than T'. Because the value of a lateral release retention moment is a function of T'l' in the case of a pure lateral pivoting and a function of $T'_{3l}$, when there is a vertical pivoting at the same time, the lateral release retention moment is reduced when a lateral and vertical pivoting occur simultaneously, as compared to a lateral pivoting alone.

Figure 20:
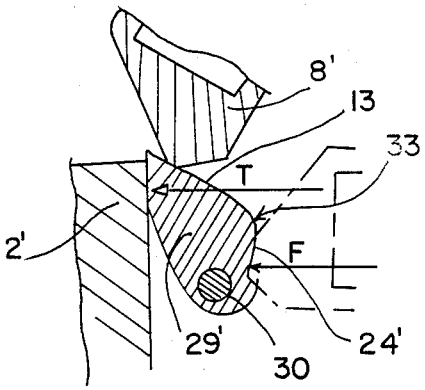
FIGS. 20 and 21 illustrate alternative embodiments of the cooperation between the elastic system, support and pivot.

FIG. 20 shows another embodimant of the locking system wherein axis pin 30 of lever 29' is positioned below its location in FIGS. 14–16 so that elastic system 7', when it is in the position when there is no boot present (shown by the dotted line), acts positively on rocker 29' to assure that force T maintains jaw 4' in its centered retention position without the need for an auxiliary spring 35. The nose of piston 8' is constantly in contact with rocker 29', regardless of the position of the jaw and produces a force F against rocker 29'.

Figure 21:
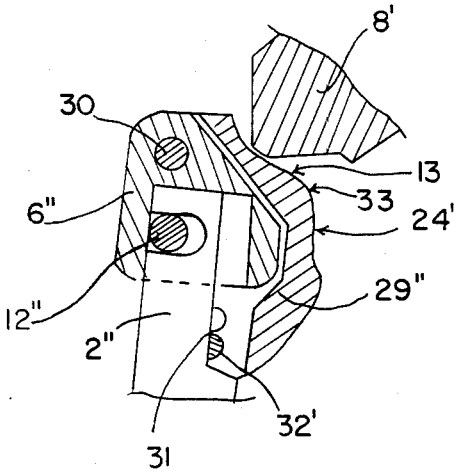

FIG. 21 illustrates an embodiment wherein lever 29'' is journalled on pivoting element 6'' around axis pin 30 located on the upper section of pivoting element 6'. The lower section of lever 29'' comprises an activation element 32' biased against side 31 of support 2 to maintain the lateral position of the jaw. In this embodiment incline 13 is located below a horizontal plane passing through axis pin 30.

Figure 22:
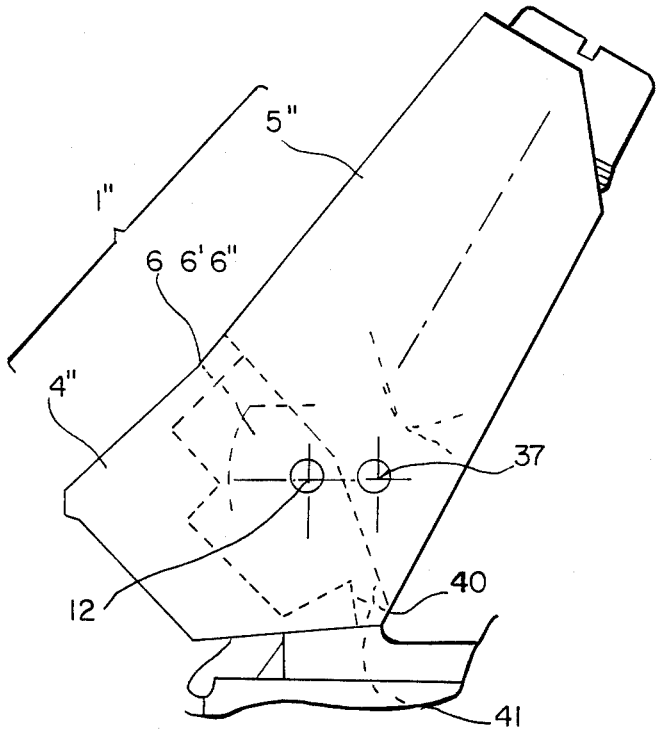
FIGS. 22–24 show an alternative embodiment in which the body is journalled on the jaw.
Figure 23:
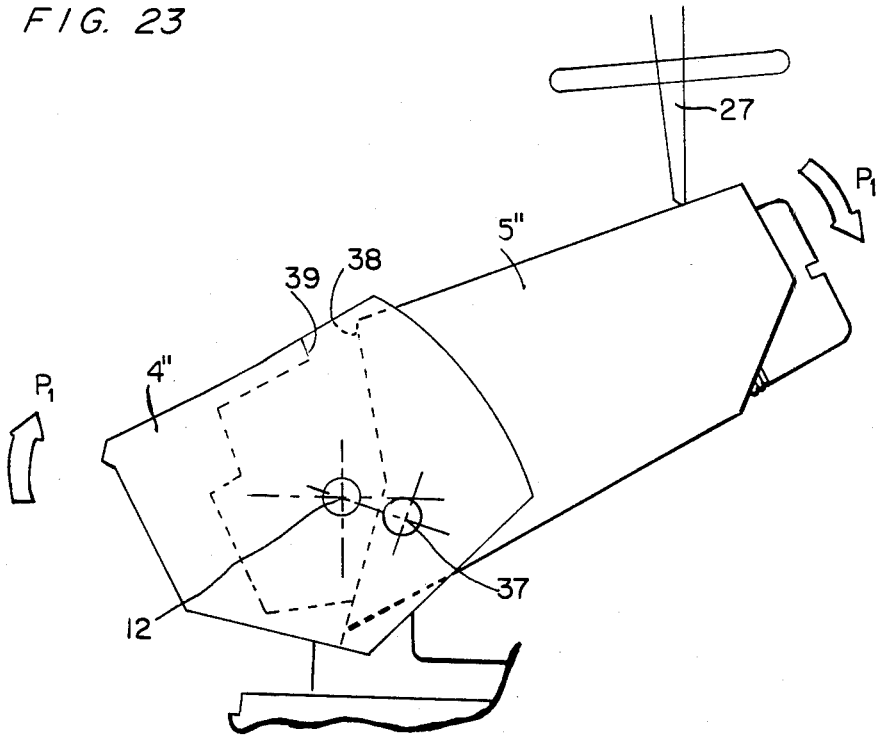
Figure 24:
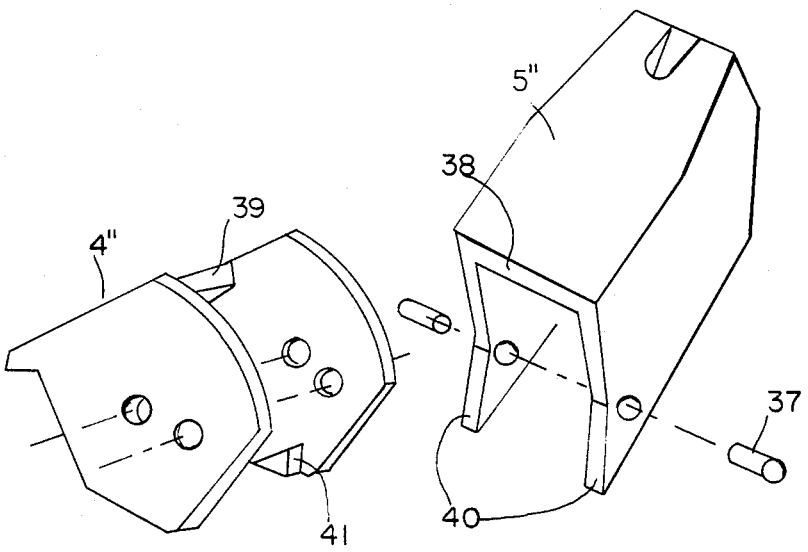

In the preceding embodiments, body 5 or 5' comprised an extension in the form of a jaw integral with body 5 or 5'. A body 5'' which extends behind jaw 4'' but which is not integral therewith, is shown in FIGS. 22–24. In effect, body 5'' is journalled on jaw 4'' around transverse axis pin 37. In addition, a stop system 38–39 and 40–41 is provided to permit the body and the jaw to cooperate so that the boot may be more easily removed from the binding by the skier and so that the boot may be replaced in the binding automatically.

FIG. 22 illustrates the binding in a locked position for the retention of the boot. Top stop 38 of body 5'' contacts top stop 39 of jaw 4''; during a vertical safety release of the boot, jaw 4'' carries body 5'' therewith in the direction $P_1$. Voluntary manual release of the boot, on the other hand, occurs in two phases. In the first phase, body 5'' pivots in the direction $P_1$ around axis pin 37 until bottom stop 40 on body 5'' comes into contact with bottom stop 41 on jaw 4''. During the second phase, body 5'' rotates jaw 4'' as may be seen in FIG. 23.

Figure 25:
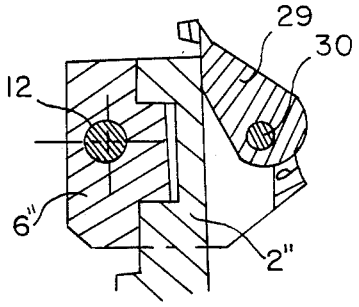
FIGS. 25 and 26 show alternative embodiments of the cooperation of the rocker, support and pivot.

The jaw assembly as shown in FIGS. 9–16 may also be embodied in the binding illustrated in FIGS. 1–8. This is shown in FIG. 25. Specifically, the manner in which the vertical retention of the jaw assembly is achieved in FIGS. 1–8 may be substituted for the manner in which the assembly is vertically retained in the embodiment using rocker 29, as seen in FIGS. 11–19. The vertical retention of the jaw assembly in the embodiment seen in FIG. 11 uses a transverse axis pin 12 which passes through support 2 and jaw 4. The embodiment shown in FIGS. 1–8 on the other hand, discloses transverse axis pin 12 passing through pivot element 6, and pivot element 6 in turn is vertically retained in support 2. FIG. 25 combines these two embodiments by disclosing transverse axis pin 12 passing through pivoting element 6'', as in FIGS. 1–8, but this vertical retention means of jaw 4 is incorporated into the binding of FIGS. 11–19 which includes rocker 29.

Figure 26:
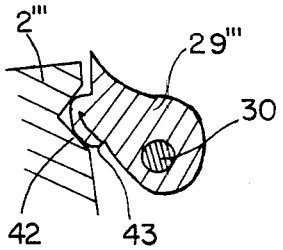

To guarantee lateral pivoting and release of the boot, cooperation between rocker 29 and support element 2 can take many forms. The embodiments illustrated in FIGS. 1–28 are an example of this cooperation. In FIG. 26, an alternative embodiment is illustrated wherein a projection 43 on rocker 29''' cooperates with a groove 42 in support 2'''.

Figure 27:
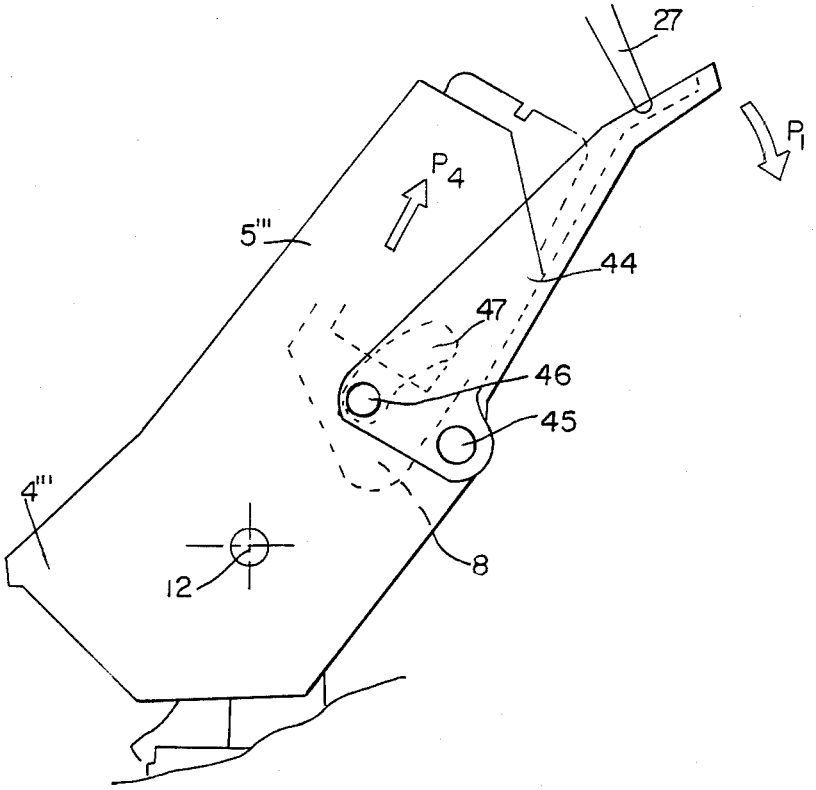
FIG. 27 illustrates another embodiment of the release, having a lever for facilitating the removal of the boot.

FIG. 27 shown an alternate embodiment of a voluntary release binding. A lever 44 is provided for removing the boot. Lever 44 is journalled on body 5''' around an axis pin 45. Lever 44 comprises a cross piece 46 connected to piston 8. A slot 47 is provided in the lateral walls of body 5''' so that the crosspiece can move therein. The movement of lever 44 in the direction $P_1$ causes the piston to retract in the direction $P_4$.

Figure 28:
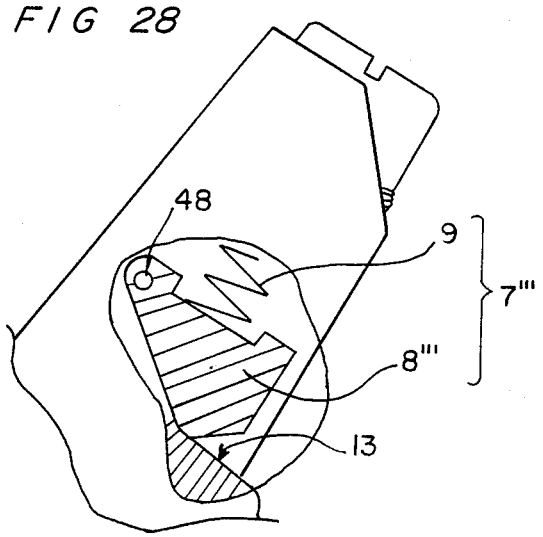
FIG. 28 illustrates an alternative embodiment of the elastic system.
Figure 29:
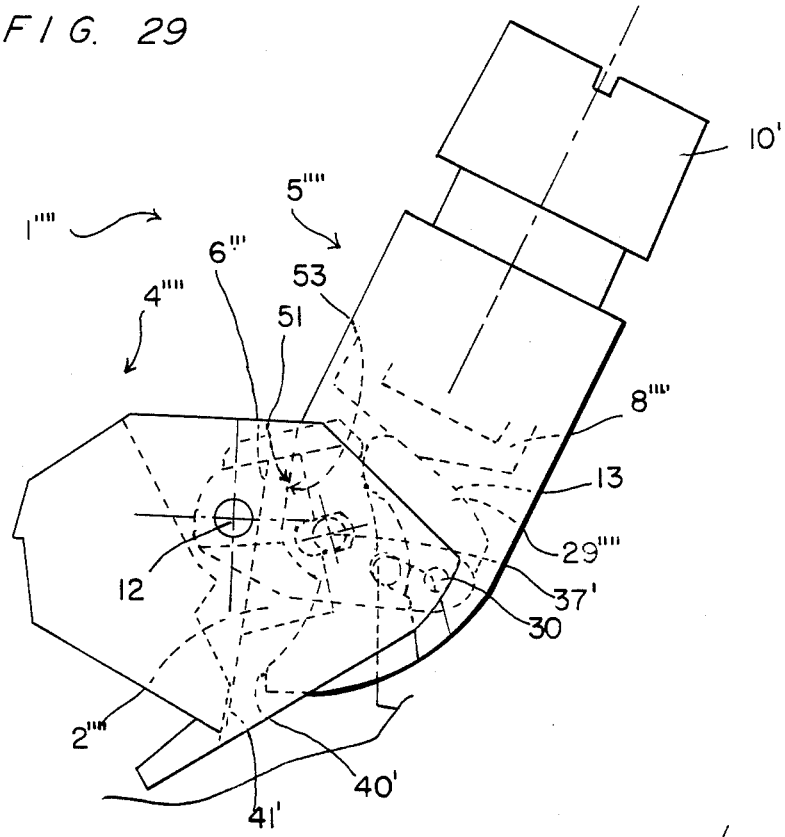
FIGS. 29–32 illustrate an alternative embodiment of the binding, wherein the body is journalled on the pivot.

FIG. 28 shows an alternative embodiment of the elastic system, wherein the mobile member is a lever 8''' journalled on the body around axis pin 48 and biased by a spring 9.

It should be noted that the bindings described hereinabove may be used in combination with all types of bindings intended to grip either end of the boot or any other part of the boot.

Figure 30:
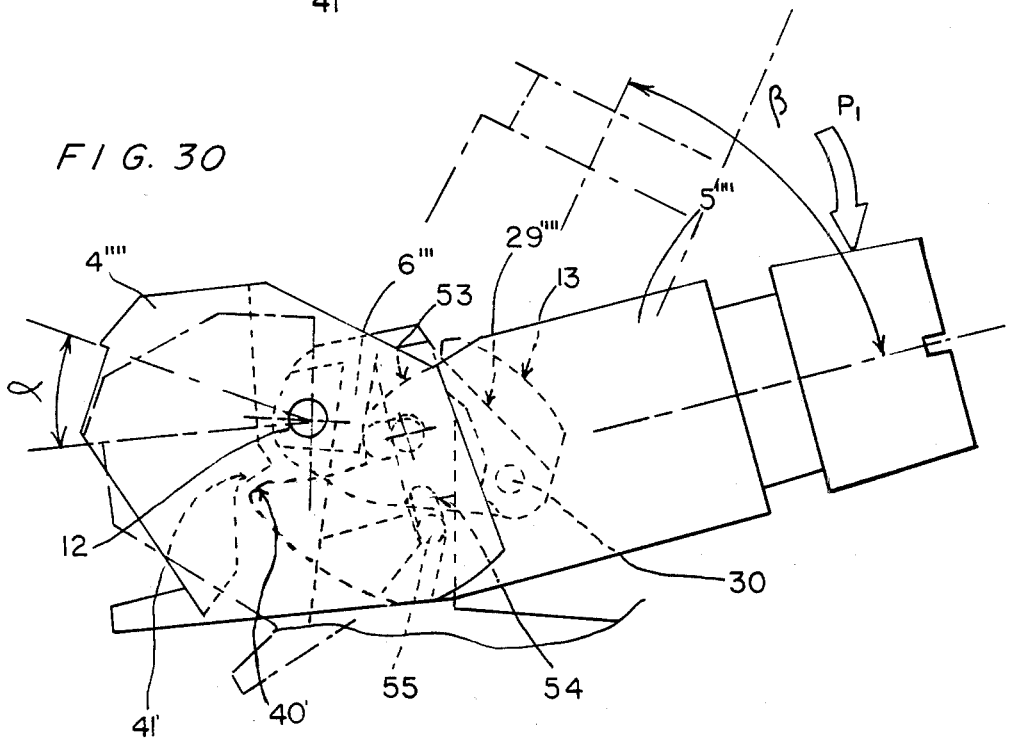
Figure 31:
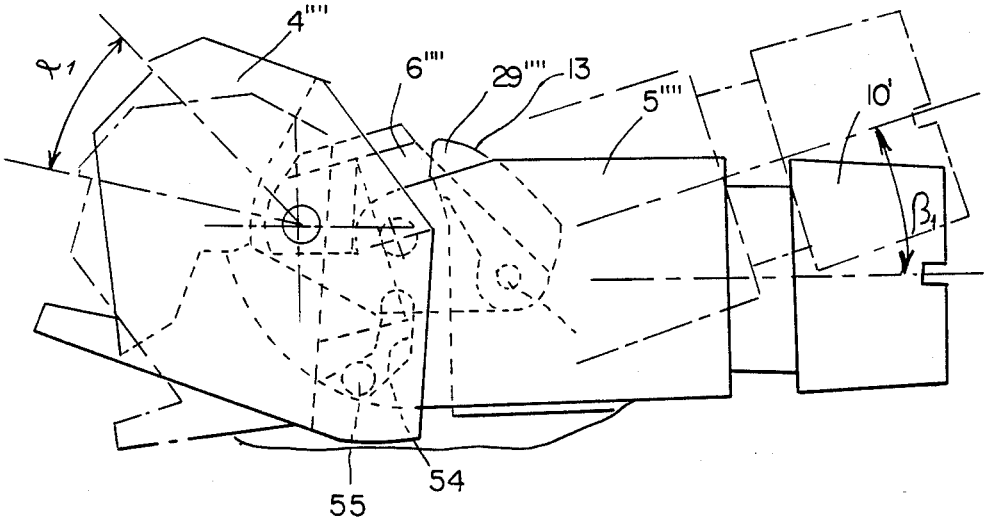
Figure 32:
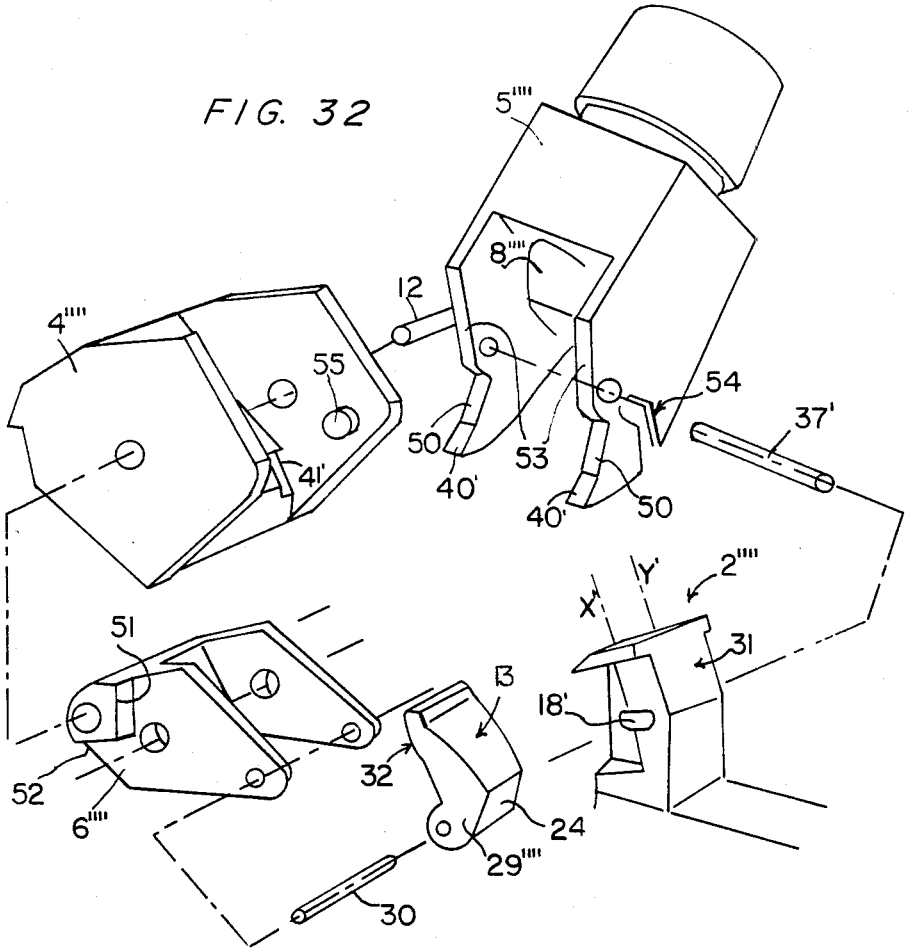

FIGS. 29–32 show another alternative embodiment of the binding, wherein body 5'''' is not journalled on the jaw as in the embodiments illustrated in FIGS. 25 and 26. Rather, body 5'''' is journalled on the pivoting element 6''' around axis pin 37'. All like elements used in the other embodiments are also found here, in this embodiment. These elements have the same reference numbers; however, these reference numbers are distinguished from other embodiments by adding apostrophe's at the end thereof (for example, 4', 4'', 4''', . . . ). Body 5'''' has two stop systems on its bottom. Bottom stops 40' and lower stops 50 comprise one system and upper stops 53 comprise the other stop system. In addition, the lower section of the lateral walls of body 5'''' comprises another incline system 54. Pivoting element 6''' has two pairs of stops, bottom stops 51 and upper stops 52, and there are two projections 55 and two stops 41' inside jaw 4''''. The position of body 5'''' (FIG.29) is determined by the cooperation of the body's stops 53 with stops 51 of pivot 6'''' when the boot is in place. Voluntary release of the boot occurs, as described previously, by the pivoting of the body 5'''' in the direction $P_1$ around an axis pin 37' in two phases. First, incline 34 in cooperation with projection 55 forces jaw 4'''' to pivot upwards (FIG. 30). Next body stop 40' comes into contact with stop 41' located in jaw 4''''. Thus the bottom section of the body, by the engaging of stops 40' and 41', forces the jaw to pivot upwards. The pivoting of the body 5'''' in the direction $P_1$ is halted when stop 50 contacts stop 52 of pivoting element 6''' (FIG. 31).

During the first phase of the voluntary removal of the boot, the angle $\beta$ through which body 5'''' moves is greater than the angle $\alpha$ through which the jaw 4'''' moves (FIG. 30). Consequently, the force necessary for removing the boot is smaller than the force required to remove a boot attached to a binding having a jaw that is integral with the lever. During the second phase, and given the position of the jaw and body, the angle $\alpha_1$ is at least equal to $\beta_1$. Thus, a small rotation of the body at the end of the binding causes a large rotation of the jaw at the other end of the binding to its open position so that the jaw is in a good position for reinsertion of the boot.

Figure 33:
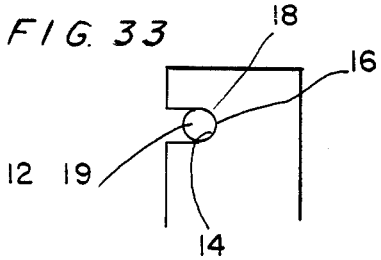
FIGS. 33–35 are schematic views of the support and pivoting element showing the support of the pivoting element.
Figure 34:
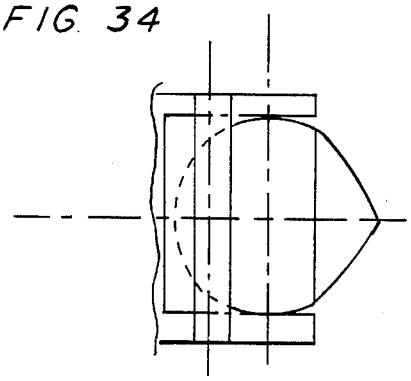
Figure 35:
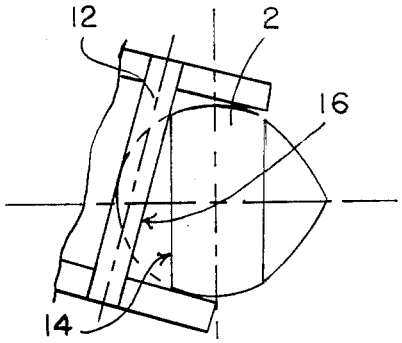

Another embodiment is shown in FIGS. 33–35 which illustrates the cooperation between pivot 6 and support 2 when pivot 6 pivots therearound. Axis pin 12 around which pivot 6 pivots engages throat, recess or housing 18 in support 2 to ensure the vertical retention of a pivot 6, while at the same time allowing the assembly to pivot. In addition, the structure and positions of recess 18 and pin 12 is such that they permit assembly 1 and pivoting element 6 to move forward. This is accomplished, as can be seen in FIGS. 33 and 35 by the resting face 16 of pin 12 against rear side 14 of recess 18. The rear portion of pivoting element 6 can disengage from side 14 of support 2 as seen in FIG. 35 to permit the forward translation of the assembly.

It should be noted that it is within the scope of the invention to include an embodiment having a stop to prevent purely lateral releases such as for example, the one described in French Pat. No. 72.17049, which is hereby incorporated by reference.

Although the invention has been described with respect to particular means and embodiments, it is to be understood that the invention is not limited to the particulars disclosed and extends to all equivalents falling within the scope of the claims.

What is claimed is:

1. A safety binding for a ski, comprising:

(a) a support, attached to said ski having a front surface; and (b) an assembly comprising:

(i) a jaw, adapted to hold at least a portion of a boot and to be able to pivot both laterally and vertically;

(ii) a pivoting element having a rear surface, adapted to engage said front surface of said support and to pivot with respect to said support, wherein said jaw is adapted to pivot vertically on said pivoting element around a transverse axis; and (iii) an elastic means for biasing said jaw against lateral and vertical pivoting.

2. The safety binding of claim 1 wherein said elastic means is adapted to bias said support and pivoting element into contact with each other.

3. The binding of claim 1 wherein said assembly further comprises a body, housing said elastic means and extending rearwardly and upwardly from said jaw.

4. The binding of claim 1 wherein said support has a rear portion and wherein said elastic means contacts said rear portion of said support.

5. The binding of claim 4 wherein said support has a vertical axis passing through the longitudinal axis thereof, wherein said pivoting element is adapted to pivot therearound.

6. The binding of claim 5 wherein said support and pivoting element comprise a lateral pivoting system having a vertical retention means for vertically retaining said pivoting element in relation to said support.

7. The binding of claim 6 wherein said vertical retention means include a vertical retention groove on said front surface of said support having beveled ends, and a vertical retention projection on the rear surface of said pivoting element adapted to engage said vertical retention groove.

8. The binding of claim 7 wherein said vertical retention groove has the shape of at least part of a cylinder.

9. The binding of claim 4 wherein said rear portion of said support comprises: a release incline extending rearwardly and downwardly from the front portion of said support, and an opening incline extending downwardly and forwardly from one end of said release incline, and wherein said elastic means is adapted to contact and move over said rear portion of said support.

10. The binding of claim 9 wherein when said assembly undergoes lateral stress, said assembly pivots laterally and said assembly moves forward.

11. The binding of claim 4 wherein said elastic means is adapted to pivot vertically and laterally and wherein said support comprises a compressing means for compressing said elastic means when said elastic means pivots vertically away from a centered boot retaining position.

12. The binding of claim 11 wherein said compressing means comprises a release incline extending downwardly and rearwardly from the front portion of the support.

13. The binding of claim 11 wherein said assembly further includes a body, attached to said jaw, wherein said elastic system is housed in said body and wherein said jaw is in an open position when said boot is released, and wherein said support further comprises a decompressing means for decompressing said elastic means after said elastic means has been compressed by said compressing means and said boot has been released from said jaw, wherein said decompressing means holds said jaw in its open position after the boot is released.

14. The binding of claim 13 wherein said decompressing means comprises an opening incline extending downwardly and forwardly from one end of said release incline.

15. The binding of claim 9 wherein the rear portion of said support comprises a release incline in the shape of a trapezoid whose two lateral edges converge downward.

16. The binding of claim 4 wherein the interaction of said rear portion of said support and said elastic system interact to produce a lateral release retention moment at a given lateral position of said assembly, which opposes the lateral pivoting of said assembly, wherein said support further includes a reduction means for reducing the lateral release retention moment when said assembly pivots laterally and vertically, as compared to when said assembly pivots laterally.

17. The binding of claim 16 wherein said reduction means comprises a release incline in the shape of a trapezoid whose two lateral edges converge downward.

18. The binding of claim 4 wherein said assembly further includes a body integral with said jaw, wherein said elastic system is housed in said body.

19. The binding of claim 2 wherein said pivoting element further includes a rocker journalled on said pivoting element, wherein said elastic means is adapted to contact said rocker.

20. The binding of claim 19 wherein said support has a rear portion and said rocker has a front portion and rear portion, wherein the front portion of said rocker is adapted to contact the rear portion of said support.

21. The binding of claim 20 wherein said pivoting element is adapted to pivot around a vertical axis passing through the longitudinal axis of said support.

22. The binding of claim 21 wherein said support and pivoting element comprise a lateral pivoting system having a vertical retention means for vertically retaining said pivoting element in relation to said support.

23. The binding of claim 22 wherein said vertical retaining means further includes a pin extending laterally through said jaw and on which said pivoting element is journalled, and a housing, in said support adapted to engage said pin.

24. The binding of claim 20 wherein said rocker has a rear portion adapted to contact such elastic means.

25. The binding of claim 24 wherein the rear portion of said rocker comprises a release incline, extending rearwardly and downwardly from the front portion of said rocker, when viewed from the top of said rocker.

26. The binding of claim 25 wherein said assembly is adapted to pivot laterally, wherein when said assembly experiences lateral stress said assembly pivots laterally and said assembly also moves forward.

27. The binding of claim 24 wherein said elastic means is adapted to pivot vertically and wherein said rocker comprises a compressive means for compressing said elastic means when said elastic means pivots vertically away from a centered boot retaining position.

28. The binding of claim 27 wherein said compressing means is a release incline extending rearwardly and downwardly from the front portion of said rocker when viewed from the top of said rocker.

29. The binding of claim 28 wherein said rocker further includes a release nose, on the end of said release incline, wherein, when said elastic means contacts said nose, the boot is released.

30. The binding of claim 29 wherein said pivoting element further includes a decompressive means for decompressing said elastic means, and positioned so that said elastic means contacts said opening incline when pivoting vertically passed said release nose.

31. The binding of claim 30 wherein said decompressive means is an opening incline, extending downwardly and forwardly from said front portion of said pivoting element.

32. The binding of claim 20 further including a locking means for locking said assembly in a centered boot retaining position when said boot is attached to said jaw when said assembly in an open position.

33. The binding of claim 32 wherein said locking means comprises a spring for biasing said rocker into contact with said support.

34. The binding of claim 32 wherein said locking system comprises a projection on said elastic means, wherein said projection biases said rocker against said support when said elastic means contacts said opening incline.

35. The binding of claim 32 wherein said locking system comprises an axis pin attaching said rocker to said pivoting element and around which said rocker pivots around said pivoting element, wherein said pin is so positioned that said elastic means biases said rocker against said support when said assembly is in its open position.

36. The binding of claim 20 wherein the interaction of said rocker and said elastic means produces a lateral release retention moment at a given lateral position of said assembly which opposes the lateral pivoting of said assembly, wherein said rocker is a reduction means for reducing the lateral release retention moment at a given lateral position when said assembly pivots laterally and vertically as compared to when said assembly pivots laterally.

37. The binding of claim 36 wherein said reduction means includes a release incline extending rearwardly and downwardly from the front portion of said rocker.

38. The binding of claim 25, wherein said rocker pivots around an axis and wherein said incline is positioned above a horizontal plane passing through said axis.

39. The binding of claim 25 wherein said rocker pivots around an axis and wherein said incline is positioned beneath a horizontal plane passing through said axis.

40. The binding of claim 24 further including a body housing said elastic means, wherein said jaw is integral with said body.

41. The binding of claim 24 further including a body housing said elastic means and within which said pivoting element pivots, wherein said body is journalled on said jaw around an axis transverse to the longitudinal axis of said binding.

42. The binding of claim 41 wherein said body includes a top stop and bottom stop and said jaw includes a top stop and bottom stop wherein said stops are so positioned that when said assembly is in its centered boot retaining position, said bottom stops of said body and jaw are spaced apart to permit vertical pivoting of said body with respect to said jaw toward the open position of said binding.

43. The binding of claim 42 wherein said top stops are so positioned that they contact each other where the assembly is in its centered boot retaining position.

44. The binding of claim 24 wherein said rocker has a projection thereon for mating with a recess in said support.

45. The binding of claim 24 wherein said elastic means includes a piston and spring wherein said assembly further includes a body housing said elastic means, wherein said body includes a lever means, journalled on said body for retracting said piston.

46. The binding of claim 24 wherein said elastic means includes a mobile member and spring and said assembly further includes a body housing said elastic means, wherein said mobile member is a lever journalled on said body.

47. The binding of claim 24 wherein said assembly further includes a body, housing said elastic means wherein said body is journalled on said pivoting element.

48. The binding of claim 47 wherein said body includes an incline and said jaw comprises at least one projection wherein said projection of said jaw and said incline of said body are so positioned that said projection engages said incline to pivot said jaw upward, when said body is rotated in one direction away from said centered boot retaining position.

49. The binding of claim 48 wherein said body includes at least one bottom stop and said jaw includes at least one stop wherein said botton stop are so positioned as to contact each other after said projection contacts said incline as said assembly pivots away from said centered boot retaining position.

50. The binding of claim 49 wherein said body further includes at least one lower stop and said pivoting element includes at least one bottom stop, wherein said lower stop of said body and said bottom stop of said pivoting element are so positioned that they contact each other and prevent further upward pivoting of said assembly at some point after said assembly has pivoted upward to an open position wherein said boot is released.

51. The binding of claim 49 wherein the angle through which said body pivots before said bottom stop of said jaw and body contacts said stop of said jaw is greater than the angle through which said jaw pivots.

52. The binding of claim 50 wherein after said bottom stop of said body contacts said stop of said jaw, as said assembly pivots, the angle through which said jaw pivots is at least as great as the angle through which said body pivots.

53. The binding of claim 22 wherein said lateral pivoting system further includes a lateral pivoting and forward moving means for permitting said pivoting element to pivot laterally and to permit said pivoting element and assembly to move forward.

54. The binding of claim 53 wherein said vertical retaining means and said lateral pivoting and forward moving means comprises:

(a) a pin extending laterally through said pivoting element;

(b) a housing in said support adapted to engage said pin.

55. The binding of claim 1 wherein said front surface of said support is substantially flat and said rear surface of said pivoting element is substantially flat.

56. The binding of claim 1 wherein said pivoting element comprises an element positioned only in front of said support.

57. The binding of claim 56 wherein said assembly further comprises a body housing said elastic means and extending rearwardly from said support, wherein said pivoting element and said body are two separate elements.

58. The binding of claim 1 wherein said elastic means is adapted to pivot vertically around said transverse axis with said jaw in response to vertical pivoting of said jaw.

59. The binding defined by claim 58 wherein said support comprise a rear surface and wherein said jaw is rigidly attached to said elastic means so that displacement of said jaw vertically and/or horizontally results in the same displacement of said elastic means, and wherein said elastic means contacts said rear surface of said support during vertical and/or horizontal displacement of said elastic means.

60. The binding of claim 59 wherein said elastic means produces a moment comprising a leaver arm, wherein the shape of said rear surface of said support is such that said lever arm is reduced during simultaneous lateral and vertical pivoting of said elastic means, as compared to lateral pivoting alone of said elastic means.

61. The binding of claim 1 wherein said elastic means produces a moment including a lever arm, wherein said support, and said assembly together comprise means for reducing said lever arm during simultaneous lateral and vertical pivoting of said jaw as compared to lateral pivoting alone of said jaw.

62. A safety binding for attaching a boot to a ski, comprising an assembly, said assembly comprising:

(a) a jaw, adapted to hold at least a portion of a boot and to be able to pivot laterally and vertically and wherein said lateral pivoting is performed around only one axis;

(b) an elastic means for producing a lateral and vertical release retention moment for causing said jaw to resist pivoting; and (c) a release retention moment reduction means for reducing said lateral release retention moment when said jaw pivots laterally and vertically, as compared to said lateral release retention moment when said jaw pivots laterally.

63. The safety binding of claim 62 further including a support and wherein said assembly further includes a pivoting element adapted to laterally pivot, wherein said elastic means biases said support and pivoting element into contact with each other.

64. The binding of claim 63 wherein said support has a front face having at least a portion that is substantially flat adapted to engage a substantially flat portion of said pivoting element.

65. The binding of claims 63 wherein said jaw is journalled on said pivoting element around an axis transverse to the longitudinal axes of said binding.

66. The binding of claim 62 wherein said assembly further comprises a body, housing said elastic means and extending rearwardly and upwardly from said jaw.

67. The binding of claim 63 wherein said support has a rear portion and wherein said elastic means contacts said rear portion of said support.

68. The binding of claim 67 wherein said elastic means is adapted to pivot vertically and laterally and wherein said support comprises a compressing means for compressing said elastic means when said elastic means pivots vertically away from a centered boot retaining position.

69. The binding of claim 68 wherein said compressing means comprises a release incline extending downwardly and rearwardly from the front portion of the support.

70. The binding of claim 69 wherein said assembly further includes a body, attached to said jaw, wherein said elastic system is housed in said body and wherein said jaw is in an open position when said boot is released, and wherein said support further comprises a decompressing means for decompressing said elastic means after said elastic means has been compressed by said compressing means and said boot has been released from said jaw, wherein said decompressing means holds said jaw in its open position after the boot is released.

71. The binding of claim 70 wherein said decompressing means comprises an opening incline extending downwardly and forwardly from one end of said release incline.

72. The binding of claim 71 wherein the rear portion of said support comprises a release incline in the shape of a trapezoid whose two lateral edges converge downward and wherein said release retention moment reduction means is said release incline.

73. The binding of claim 65 wherein said pivoting element further includes a rocker journalled on said pivoting element, wherein said elastic means is adapted to contact said rocker.

74. The binding of claim 73 wherein said support has a rear portion and said rocker has a front portion and rear portion wherein the front portion of said rocker is adapted to contact the rear portion of said support.

75. The binding of claim 74 wherein said rocker has a rear portion adapted to contact such elastic means.

76. The blinding of claim 75 wherein the rear portion of said rocker comprises as release incline, extending rearwardly and downwardly from the front portion of said rocker when viewed from the top of said rocker.

77. The binding of claim 66 wherein said assembly is adapted to pivot laterally, wherein when said assembly experiences lateral stress said assembly pivots laterally and said assembly also moves forward.

78. A safety binding for a ski, comprising:

(a) a support, attached to said ski having a front surface and a rear surface wherein said rear surface is in the shape of a trapezoid; and (b) an assembly comprising:

(i) a jaw, adapted to hold at least a portion of a boot and to be able to pivot both laterally and vertically;

(ii) a pivoting element having a rear surface, adapted to engage said front surface of said support and to pivot with respect to said support; and (iii) an elastic means for biasing said jaw against lateral and vertical pivoting.

* * * * *